US005137265A

United States Patent [19]

Sato et al.

[11] Patent Number: 5,137,265

[45] Date of Patent: Aug. 11, 1992

[54] SHEET POST-PROCESSING APPARATUS

[75] Inventors: Masaaki Sato; Nobutaka Uto, both of Yokohama; Mitsuhiro Mukasa, Kawasaki, all of Japan

[73] Assignee: Canon Kabushiki Kaisha, Tokyo, Japan

[21] Appl. No.: 489,244

[22] Filed: Mar. 5, 1990

[30] Foreign Application Priority Data

| | | | |
|---|---|---|---|
| Mar. 6, 1989 | [JP] | Japan | 1-54451 |
| Mar. 6, 1989 | [JP] | Japan | 1-54452 |
| Mar. 6, 1989 | [JP] | Japan | 1-54454 |
| Mar. 6, 1989 | [JP] | Japan | 1-54456 |

[51] Int. Cl.[5] ..... B42B 1/02

[52] U.S. Cl. ..... 270/53; 270/37

[58] Field of Search ..... 270/37, 53, 58

[56] References Cited

U.S. PATENT DOCUMENTS

| | | | |
|---|---|---|---|
| 4,424,963 | 1/1984 | Bartholet et al. | 270/53 |
| 4,566,782 | 1/1986 | Britt | 270/53 |
| 4,592,651 | 6/1986 | Oikawa | 270/37 |
| 4,928,941 | 5/1990 | Uto et al. | 270/53 |
| 4,946,152 | 8/1990 | Ishikawa | 270/53 |
| 5,021,837 | 6/1991 | Uto | 270/53 |

*Primary Examiner*—Edward K. Look
*Assistant Examiner*—Therese M. Newholm
*Attorney, Agent, or Firm*—Fitzpatrick, Cella, Harper & Scinto

[57] ABSTRACT

A sheet post-processing apparatus includes plural trays arranged along a sheet conveyance direction, wherein a sheet is stacked, bridging between the plural trays, wherein a post-processing is effected to the sheet in a part of the plural trays; a controller for controlling the trays to provide a level difference between the trays by lowering another one of the trays than the one of the trays; and aligning device for laterally aligning the sheet stacked, bridging between the trays providing the level difference.

15 Claims, 22 Drawing Sheets

SHEET POST-PROCESSING APPARATUS

FIELD OF THE INVENTION AND RELATED ART

The present invention relates to a sheet post-processing apparatus, more particularly to a sheet post-processing apparatus usable with an image forming apparatus or the like to process the sheet materials discharged from the image forming apparatus by sorting, stacking, stapling, punching or the like.

A sheet post-processing apparatus is known which comprises a processing tray for post-processing the sheets by stapling, punching or the like and a sheet accommodating tray, wherein the sheets on which images have been formed and which are discharged from the image forming apparatus are stapled or punched on the processing tray, and are discharged to and stacked on the sheet accommodating tray disposed below it.

Such a sheet post-processing apparatus involves a drawbacks of bulkiness because the processing tray and the accommodating tray are separately disposed. In an attempt to remove the drawback, U.S. Pat. No. 4,424,963 proposes a sheet post-processing apparatus, wherein a first post-processing means (processing tray) and a second post-processing means (sheet accommodating tray) are disposed close to each other, and a sheet is stacked bridging the first post-processing means and the second post-processing means, while the sheet is processed by the first post-processing means, and thereafter, the sheet is discharged to and stacked on the second post-processing means, by which the size of the apparatus is reduced.

However, the above-described post-processing apparatus and the post-processing apparatus disclosed in the U.S. Patent involve the problem in alignment of the sheets. More particularly, when the sheets are subjected to the post-processing, stapling, for example, on the tray, the sheets are required to be aligned, but in the above conventional structures, the alignment is not sufficient when the sheet materials are less rigid.

In the conventional structures, a rib or ribs are formed on the tray to increase the rigidity of the sheet, by which the sheets are waved. However, this involves the problem that when the number of sheets stacked increases, the rigidity increasing effect is less for the upper sheets.

SUMMARY OF THE INVENTION

Accordingly, it is a principal object of the present invention to provide a sheet post-processing apparatus and an image forming apparatus equipped with the post-processing apparatus, wherein the sheets are aligned in good order.

According to an aspect of the present invention, there is provided a sheet post-processing apparatus wherein a sheet stacking tray is divided into plural parts, and they are stepped when the sheets are stacked. The stepping between the trays is effective to bend the sheets stacked thereon, and therefore, the rigidity of the sheets is made sufficiently when a sheet aligning means pushes them laterally. As a result, the sheets can be aligned in good order.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
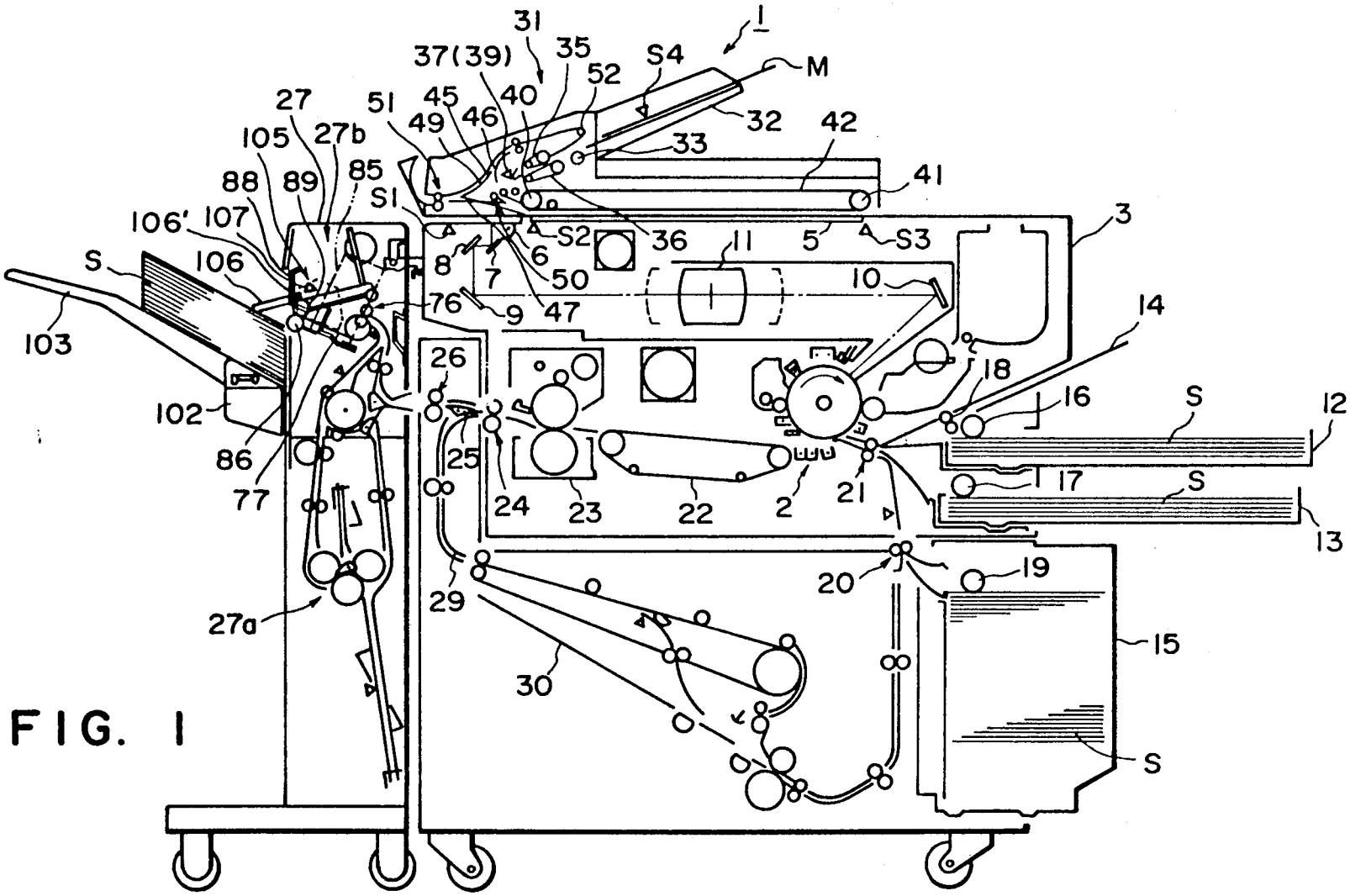
FIG. 1 is a front sectional view of a sheet post-processing apparatus according to an embodiment of the present invention.

Referring first to FIG. 1, there is shown a copying apparatus as an exemplary image forming apparatus according to an embodiment of the present invention. A copying machine 1 comprises a copying portion 2 for forming images on sheets S, and a sheet post-processing apparatus 27 is connected thereto to post-process the sheets S discharged from the copying machine 1.

Copying machine 1 (image forming apparatus)

As shown in FIG. 1, the copying machine 1 includes a main assembly 3 containing the copying portion 2. The main assembly 1 includes a platen 5, a light source 6, mirrors 7, 8, 9 and 10, a lens 11, two cassettes 12 and 13 for accommodating the sheets S, a manual feeding tray 14 for permitting irregular sheets or the like to be manually fed, and a deck 15. Above each of the cassettes 12, 13, the tray 14 and the deck 15, a pick-up roller 16, 17, 18 or 19 is disposed. A conveying portion 20 is disposed downstream of the pick-up roller 19 and close to the main assembly 3, and a pair of registration rollers 21 is disposed downstream of the conveying portion 20 and the pick-up rollers 16, 17 and 18. Downstream of the registration rollers 21, the copying portion 2 is disposed. Downstream of the copying portion 2, there are a conveying belt and an image fixing device 23.

Downstream of the fixing device 23, there are a pair of discharging rollers 24, a flapper 25 and a pair of sheet discharging rollers 24. Downstream of the sheet discharging rollers 26, there is, adjacent to the main assembly 3, a sheet post-processing apparatus 27 comprising a sheet folding section 27*a* for two-folding or z-folding the sheets S and a finisher station 27*b* for stacking or stapling the sheets S. A sheet re-feeding passage 29 is formed to be branched by the flapper 25, and the refeeding passage 29 is provided with an intermediate tray 30. Reference characters S1, S2 and S3 designate sensors.

The main assembly 3 is equipped, at its upper portion, with an automatic document feeder 31 which includes an original tray 32 for stacking documents or originals M to be copied. Adjacent the tray 32, a feeding roller 33 is provided to feed the originals M on the tray 32. Downstream of the roller 33, there are a separating belt 35 rotating in the counterclockwise direction and a conveying belt 36 rotating in the counterclockwise direction. Adjacent to the belt 36, sensors 37 and 39 for detecting the size of the original M are aligned in a lateral direction with respect to the conveyance direction of the original. Downstream of the sensors 37 and 39, a conveying belt 42 is stretched between a driving roller 40 and a follower roller 41.

At a left side of the belt 42 (original discharging portion), there is a flapper 45, around which conveying passages 46, 47 and 49 are disposed which are selected by the flapper 45. The conveying passage 46 is provided with a pair of conveying rollers 50. For the conveying passage 47, a pair of conveying rollers 51 is disposed, and in the conveying passage 49, a discharging roller 52 is provided. Designated by a reference S4 is a sensor for detecting a circulation of a sheet.

Sheet post-processing apparatus 27

Figure 2:
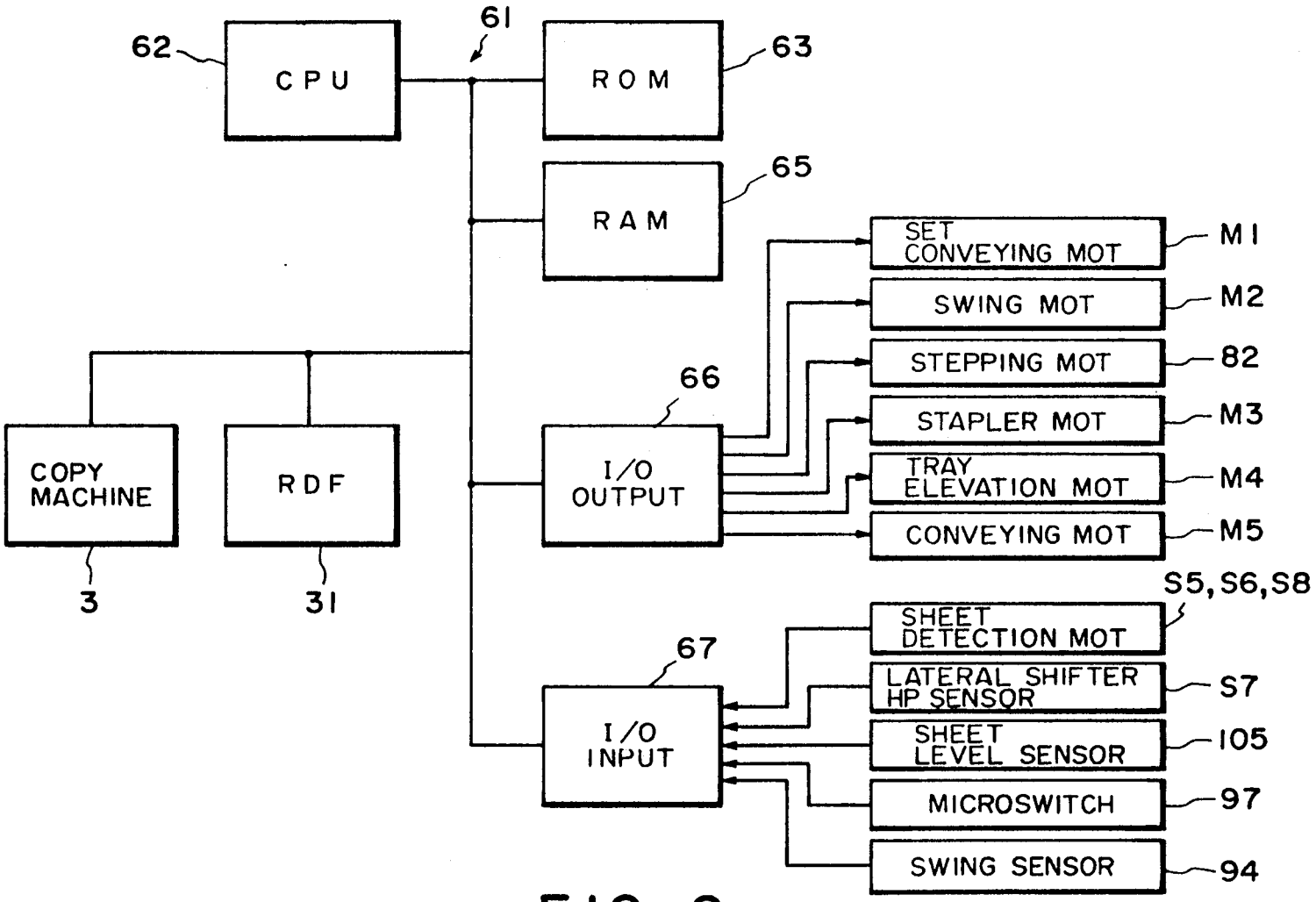
FIG. 2 is a block diagram of a control system therefor.

As shown in FIG. 2, the sheet post-processing apparatus 27 has a controller 61 which comprises a central processing unit (CPU) 62, a ROM 63 for storing a control program for controlling the CPU 62 and a RAM 65 functioning as a main memory. The controller 61 is connected with an output interface 66 for producing control signals to be fed to the loads such as a main motor and with an input interface 67 for receiving detection signals from various sensors. Also, it is connected through interfaces not shown with various loads and sensors of the main assembly 3 and the automatic document feeder 31.

The output interface 66 is connected with a stapled sheet conveying roller M1, a swinging motor M2, a stepping motor 82, a stapler motor M3, a tray elevating motor M4 and a conveying motor M5. The input interface 67 is connected with sheet detecting sensors S5 and S6, a lateral shifting plate home position sensor S7, a sheet level sensor 105 and a microswitch 97.

Figure 3:
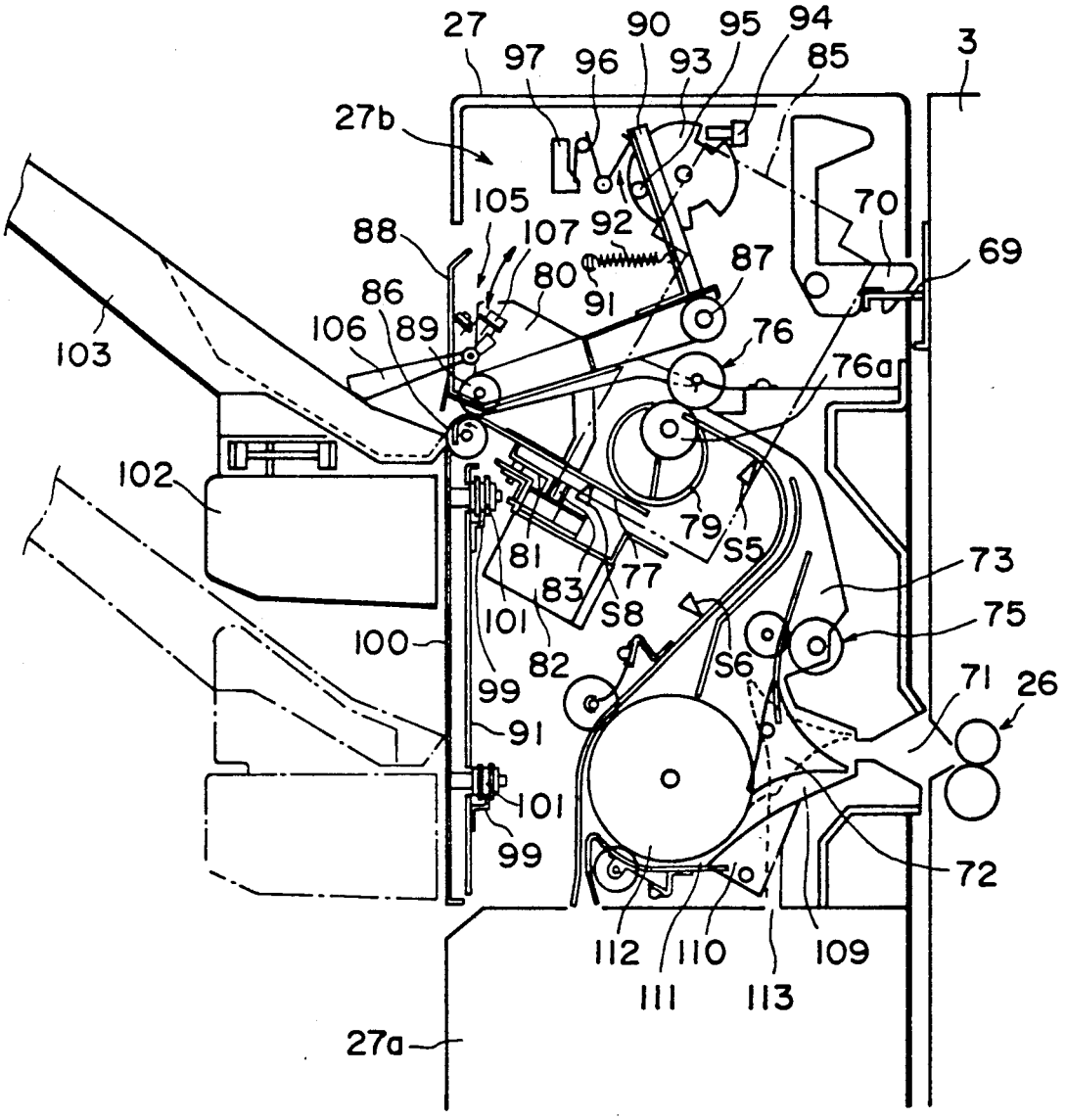
FIG. 3 is a front sectional view of a major part of the sheet post-processing apparatus.

As shown in FIG. 3, the post-processing apparatus 27 is provided with a hook 70 swingable and engageable with an engagement member 69 provided on a side of the main assembly 3 of the copying machine. By the engagement between the hook 70 and the engagement member 69, the post-processing apparatus 27 is correctly positioned. The apparatus 27 is provided with an inlet opening 71 for receiving the sheets S discharged by the sheet discharging roller 26. Downstream of the inlet 71, a deflector 72 is provided. Downstream of the deflector 72, there is a first conveying passage 73 having a pair of conveying rollers 75. Downstream of the first conveying passage 73, there is a pair of sheet discharging rollers 76, and further downstream thereof, a processing tray 77 is disposed.

The bottom one 76*a* of the pair of rollers 76 has a shaft on which a part of the belt 79 is trained, and the bottom portion of the belt 79 is contacted to the processing tray 77. The tray 77 is provided with a lateral shifting plate 80 movable in the lateral direction of the sheet S for the alignment in that direction and an unshown positioning plate. The bottom portion of the lateral shifting plate 80 is formed into a rack 81 which is meshed with a pinion gear 83 driven by a stepping motor 82 disposed below the processing tray 77. Adjacent to the processing tray 77, a stapler 85 is provided to staple front and trailing edge sides of the sheets S stacked on the tray 77.

Adjacent the downstream end of the tray 77, discharging rollers 86 are disposed, to which a swingable roller 89 disposed at a corner of a swingable guide 88 swingably supported on the shaft 87 is contacted. The swingable guide 88 is provided with a guide lever 90 planted therein. The lever 90 is connected with a spring 92 having an end fixed on a projection of a frame 91 of the apparatus, by which the swingable guide 88 is urged in the counterclockwise direction. Adjacent the guide lever 90, there is a disk 93 driven by the swinging motor M2, and the disk 93 is provided with a pin 95 planted therein and engageable with the guide lever 90. Adjacent to the disk 93, an L-shaped leaf spring 96 is swingably supported, and adjacent to the spring 96, a microswitch 97 is disposed.

The frame 91 has a rail plate 99 extending in a horizontal plane, and the rail plate 90 supports a rotatable roller 101 mounted on a hurdle guide 100. On the guide 100 a tray carriage 102 is supported for vertical movement. The movable carriage 102 is provided with a stacking tray 103 having a recess at its base side to stack the sheets S. The swingable guide 88 has a sheet level sensor 105 for detecting the level of the stack of the sheets S on the stacking tray 103. The sensor 105 is constituted by a sensor lever 106 contactable to the sheet S on the stacking tray 103 or the tray 103 and a photosensor 107. The base portion 106' of the sensor lever 106 is made of an elastic rubber or a resilient spring, so as to protect the sensor lever 106 from external force which otherwise results in damage thereof.

A second conveying passage 109 is branched out by the deflector 72, and at an end of the passage 109, a deflector 110 is disposed. Downstream of the deflector 110, a third passage 111 which is curved is formed. An inside guiding surface of the passage 111 is constituted by a large diameter roller 112, and the passage 111 communicates the first conveying passage 73. A folding passage 113 is branched by the deflector 110, and downstream of the conveying passage 113, the folding section 27*a* is disposed. Designated by references S5 and S6 are sheet detection sensors for detecting the sheet.

Figure 4:
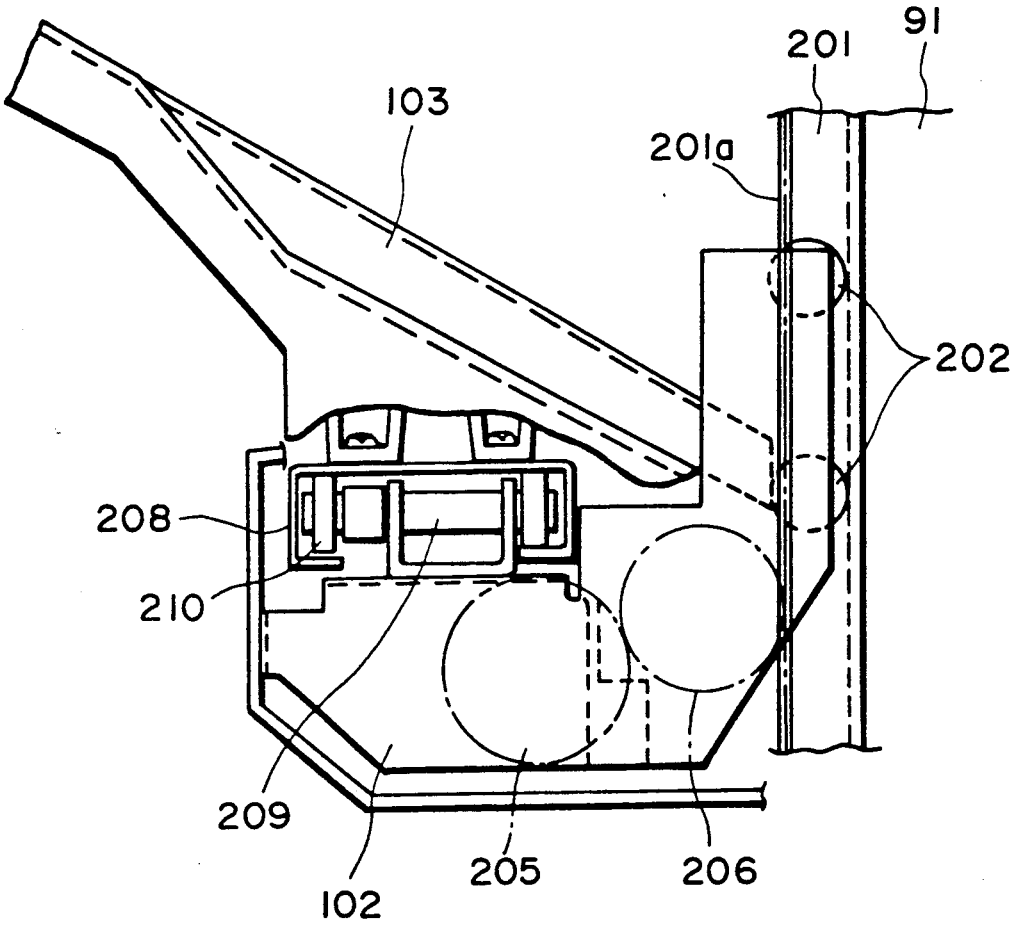
FIG. 4 is a sectional view a sheet accommodating portion.
Figure 5:
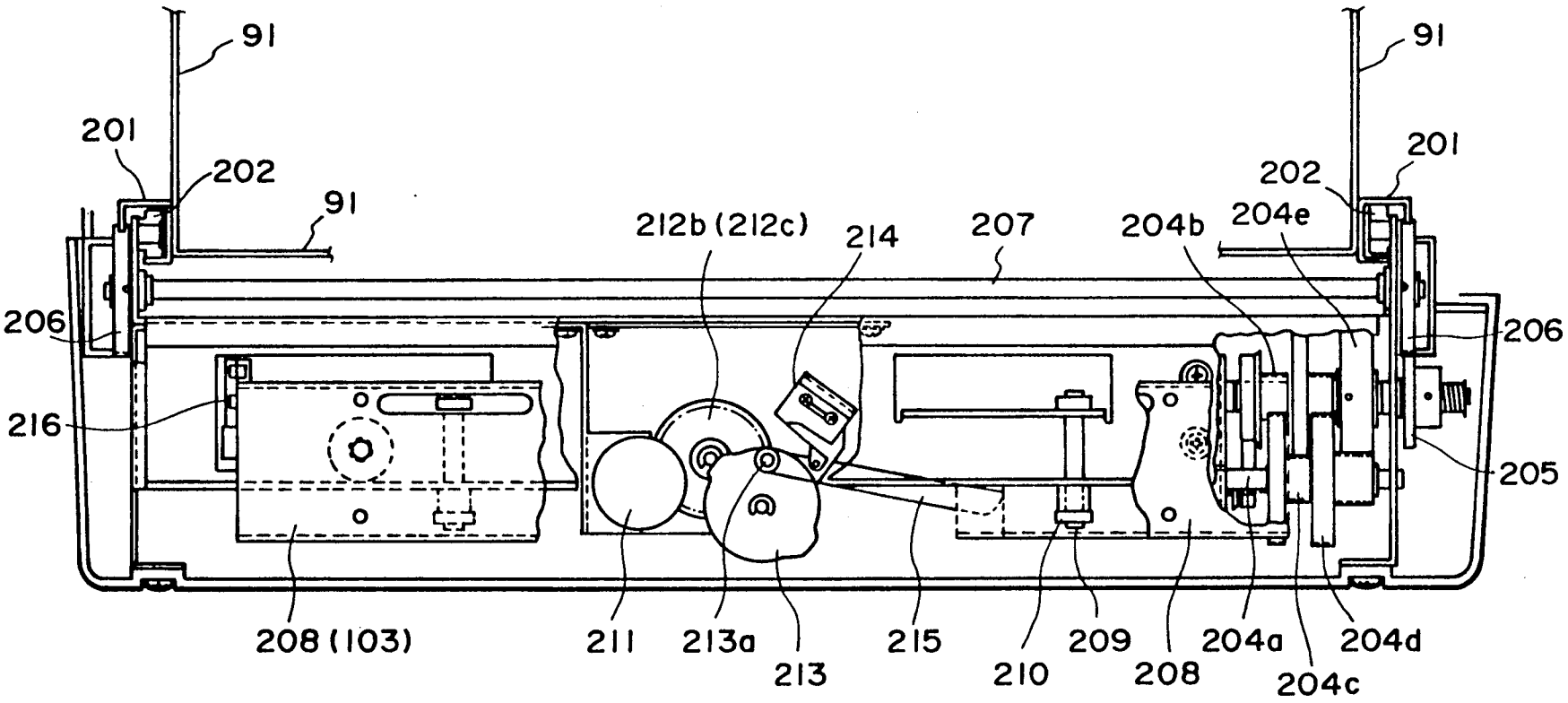
FIG. 5 is a top plan view thereof.
Figure 6:
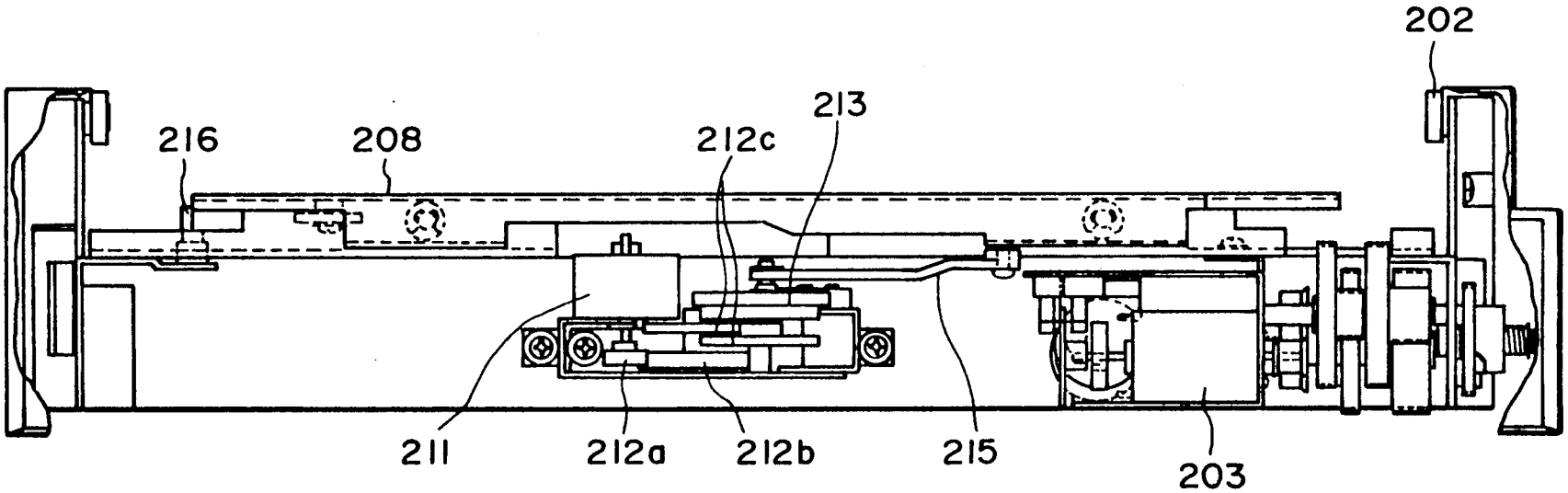
FIG. 6 is a left side view thereof.

Referring to FIGS. 4, 5 and 6, a mechanism for the vertical movement of the carriage 102 will be described. The movable carriage 102 moves in the vertical direction by sliding movement of rollers 202 in a channel-like rail members 201 in the main frame 91. The driving force for the vertical movement is transmitted from the motor 203 below the movable carriage 102 through a gear train 204a-204e, the driving gear 205 and the pinion gear 206.

The pinion gear 206 is provided at each of the front and rear sides, and the pinion gears 206 are connected by a shaft 207. In response to forward and backward rotations of the motors 203, the pinion gears 206 rotate in the forward and backward direction to move the carriage 102 up and down through the engagement thereof with the rack 201a formed on the rail member 201.

A mechanism for a horizontal movement of the stacking tray 103 will be described, further referring to FIGS. 4, 5 and 6. As shown in FIG. 4, the stacking tray 103 is fixed on a horizontally movable carriage 102 having a channel-like cross-section. A short shaft 209 is penetrated through two portions bent out from the movable carriage 102. At the opposite ends of the shaft 209, rotatable members 210 are mounted through a gearings. The rotatable member 210 is engaged with the channel-like portion of the carriage 208, so that the entirety of the movement carriage 208 is movable in a horizontal plane in a direction perpendicular to the sheet S conveyance direction.

The driving source for the carriage 208 is an off-set motor 211, the driving force of which is transmitted through driving gears 212a-212c. The most downstream gear 213 is integral with a cam disk having projected portions at diametrically opposite portions. The projections depress the off-set microswitch 214. The top surface of the gear 213 having the cam disk is provided with a pin 213a planted therein, and the pin 213a is connected with a part of the horizontally movable carriage 208 by a link 215.

Accordingly, when the off-set motor 211 rotates, the rotational motion is converted to a linear motion by the functions of the pin 213a and the link 215 to move the carriage 208 in a horizontal plane. The horizontal movement of the carriage 208 is transmitted to the hurdle guide 100 through a pin, so that the hurdle guide 100 also moves together with the tray 103. Thus, the hurdle guide 100 for receiving the leading side of the sheet on the tray 103 moves integrally.

The position where the projection of the disk cam depresses the offset microswitch 214 is such a position that the stacking tray 103 is most front or most rear as seen from the front side when the off-set microswitch 214 is rendered on. To accomplish this, the switch is disposed at the movement limit of the carriage 208 and the stacking tray 103 fixed thereto.

At the rear side of the movable carriage 102, a tray position sensor 216 is disposed to detect its edge only when the carriage 208 is at its rear side. Thus, by combination of on and off of the off-set microswitch 214 and the tray position sensor 216, the thrust position of the carriage 208 and the stack tray 103 can be detected.

Figure 7A:
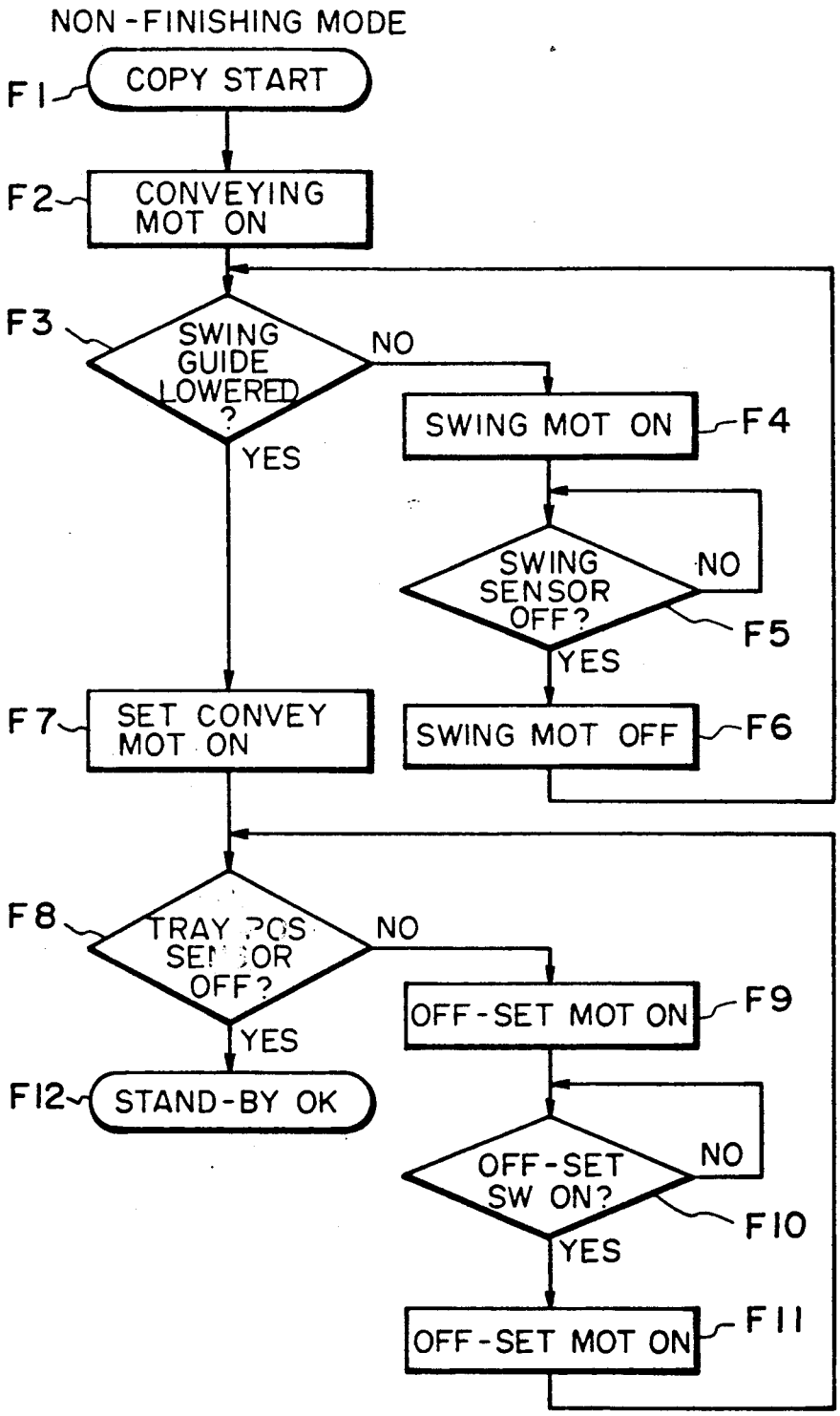
FIGS. 7A and B are flow charts illustrating operations from start to stand-by in a sheet mode operation.
Figure 7B:
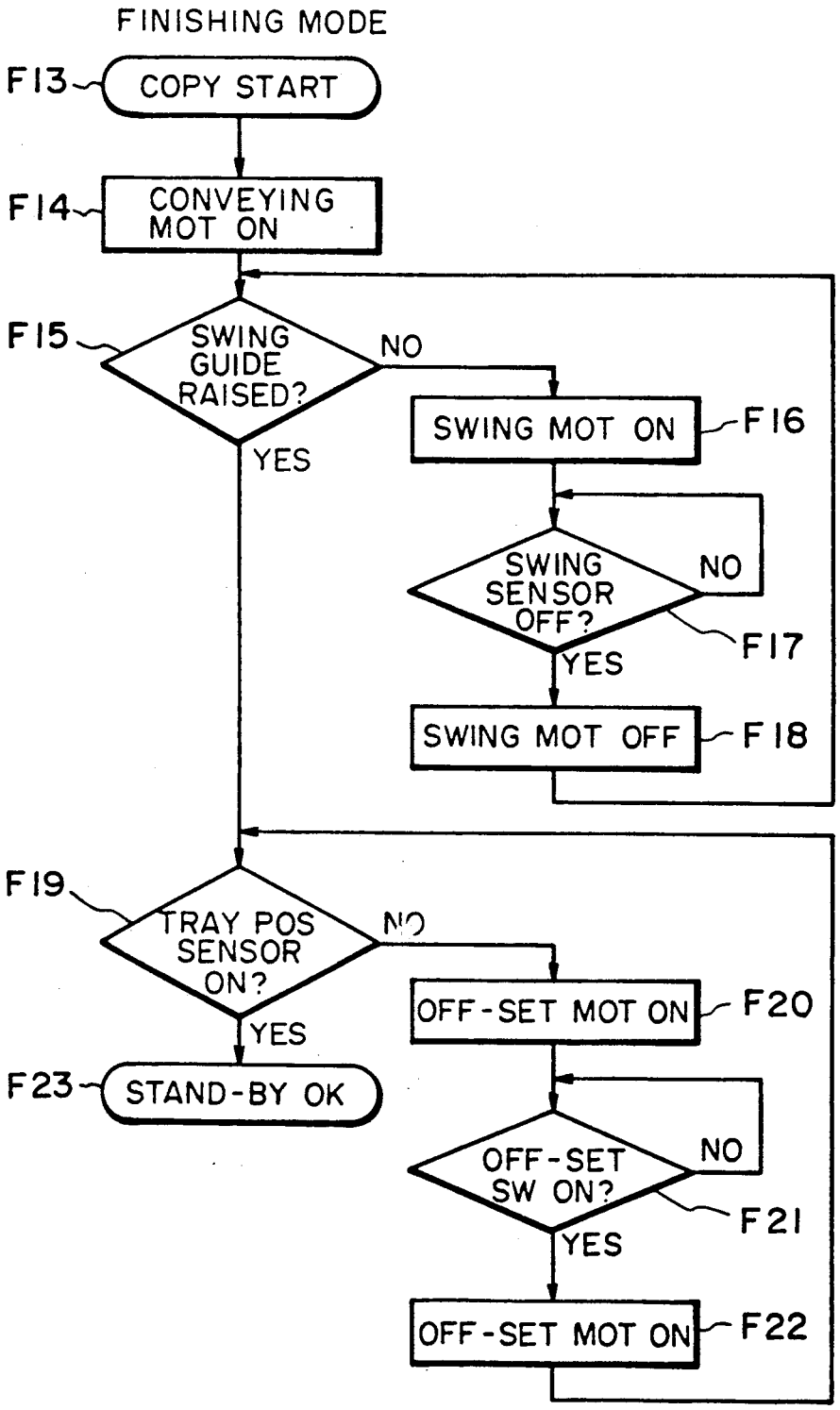

Referring to FIG. 7, the operation of the post-processing apparatus will be described.

Non-processing mode

Figure 9A:
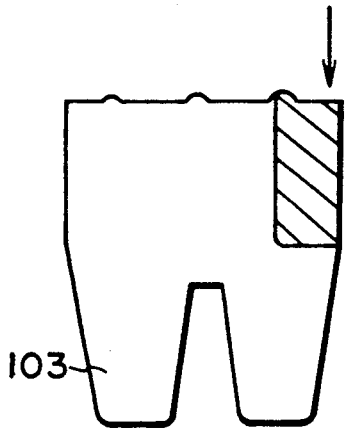
FIGS. 9A–B illustrate an operation of the sheet accommodating tray.
Figure 9B:
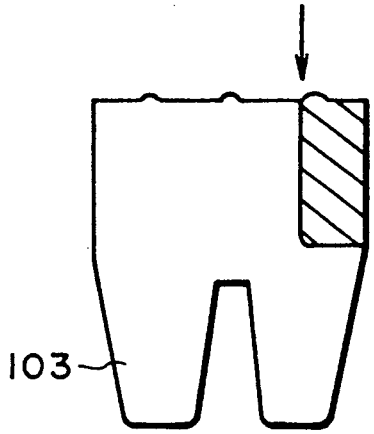

Upon copy start (F1), the conveying motor is energized (F2), and the discrimination is made as to whether or not the swinging guide 88 is at its lower position (F3). If not, the swinging motor is rotated until the swing sensor is rendered off again (F4-F6). After it is confirmed that the swing guide 88 is lowered, the stapled sheet conveying motor is actuated (F7) and the thrust position of the tray is detected. In FIG. 9, an arrow depicts the front side surface during the sheet S conveyance, and the hatched portion of the stack tray 103 is a recess. In the non-processing mode, it is desirable that the sheet is stacked at the position indicated by an arrow in FIG. 9B so that an end of the sheet does not fall in the recess of the stack tray 103.

Therefore, the control is such that the stack tray 103 is off-set to the front side. Referring back to the flow chart of FIG. 7, the discrimination is made as to whether or not the tray position sensor 216 is off or not (F8). If so, the stacking tray 103 is off-set to the front side, and therefore, it is at a proper stand-by position. If it is on, the off-set motor is actuated (F9), and is stopped when the off-set microswitch 214 is rendered on again (F10, F11), and it is confirmed that the tray position sensor is in off-state.

Referring back to FIG. 3, the sheet S is conveyed through the inlet 71 and through the first conveying passage 73 by the discharging rollers 76, and thereafter, it is passed under the swing guide 88 and is stacked on the non-recessed portion of the stacking tray 103 by the discharging rollers 86 and swinging rollers 89.

Processing mode

Figure 8A:
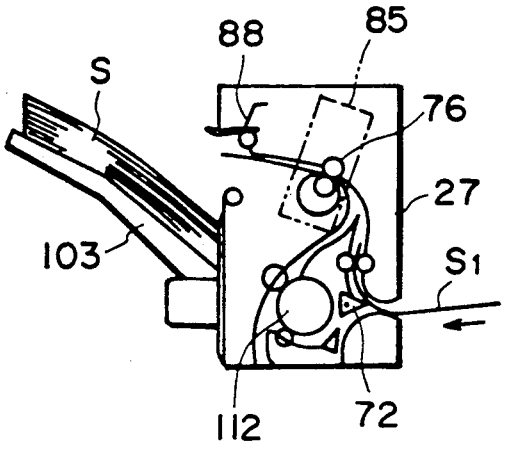
FIGS. 8A–D illustrate the sheets accommodated.

Similarly to the non-processing mode, upon the copy start (F13), the conveying motor is energized (F14). Thereafter, the discrimination is made as to whether or not the swing guide 88 is at its upper position (F15). If not, the swinging motor is actuated to raise the swinging guide 88 (F16, F17 and F18) (FIG. 8A). Subsequently, the position of the stacking tray 103 is detected. In FIG. 9, in the case where the processing mode (stapling mode, for example) is selected, it is preferable that the sheets are received by the recessed portion of the stack tray 103, that is, the portion indicated by an arrow in FIG. 9A so as to accommodate the bulge of the sheets at the stapled portions when a number of sheets are stacked. In view of this, the control is such that the stacking tray 103 is off-set to the rear side.

Referring to the flow chart, the discrimination is made as to whether or not the tray position sensor 216 is actuated (F19). If not, that is, off, the off-set motor is driven to shift the position of the stacking tray 103 (F20-F22), so that the tray position sensor 216 is rendered on, by which the stand-by state is established.

Figure 8C:
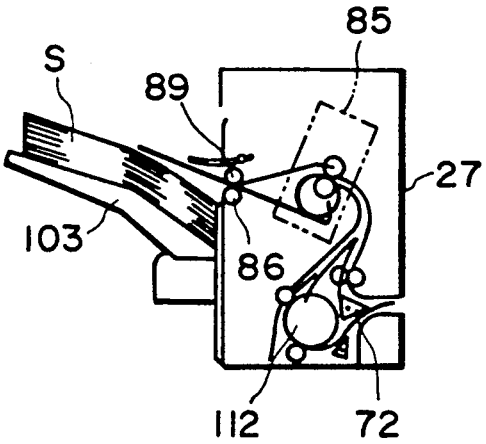
Figure 8B:
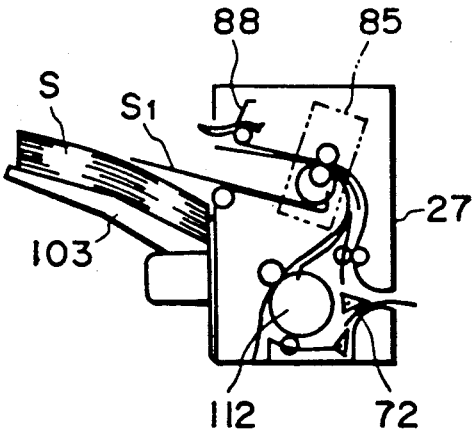

Referring to FIG. 3, the sheet S1 received by the inlet 71 is discharged through the first conveying passage 73 by the sheet discharging rollers 76, in the manner that the sheet bridges between the processing tray 77 and the stacking tray 103 (FIG. 8B). When a predetermined number of the sheets are discharged, the swing guide 88 lowers (FIG. 8C). After they are stapled, the stapled set of sheets is conveyed by the discharging rollers 86 and the swingable roller 89 to be discharged onto the stacking tray 103. At this time, the stapled portions of the sheets S are at the recessed portion of the stacking tray 103, so that the bulge of the stapled portion can be accommodated even if a great number of stapled sets of sheets are stacked.

Figure 10A:
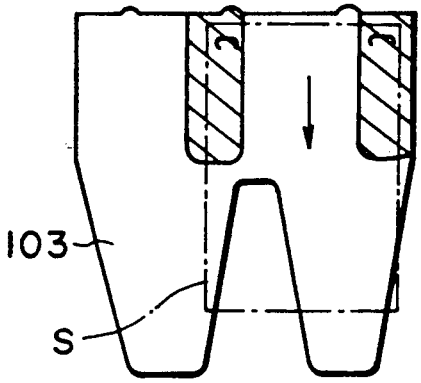
FIGS. 10A–B, 11A–B, 12A–B, 13A–B illustrate sheet accommodating tray according to another embodiment of the present invention.
Figure 10B:
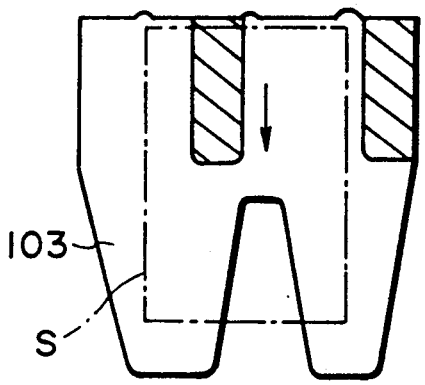

In the foregoing embodiment, the sheets S are stapled at a front and trailing edge, and the stacking tray 103 is recessed at its front and trailing side. However, the position is not limited to this, and it may be rear or leading side, or the number of positions may be one or two at the front and rear sides. In this case, as shown in FIG. 10, the tray is recessed at two portions hatched, and when the sheets are stapled, the two stapled portions are at the recessed portions (FIG. 10A), and when they are not stapled, they are stacked bridging the recess, as shown in FIG. 10B.

Figure 11A:
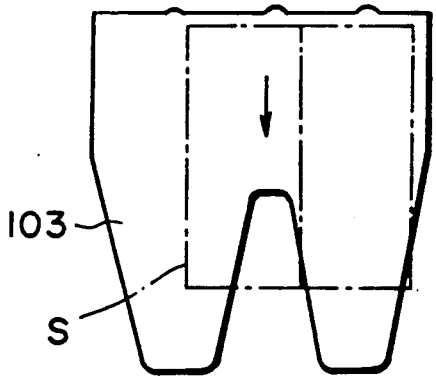
Figure 11B:
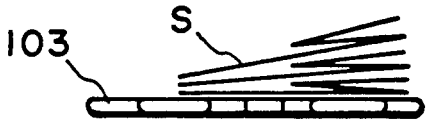

In the foregoing embodiment, the bulging due to the staples is accommodated by the movement of the stacking tray 103, but the same is used for another post-processing, for example, the stacking of folded sheets. In this case, the folding lines are codirectional with the sheet conveying direction. If the tray is flat as usual, the folded sides of the sheets bulge, as shown in FIG. 11B, so that the right side in FIG. 11B becomes taller with the result that a great number of sheets are not easily stacked.

Figure 12A:
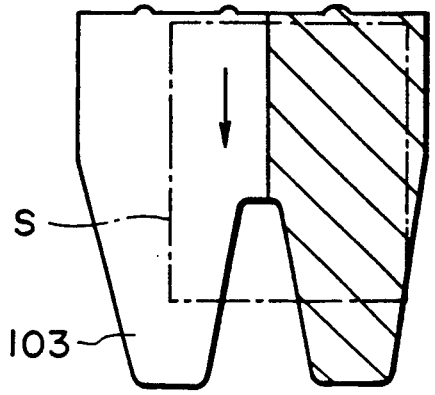
Figure 12B:
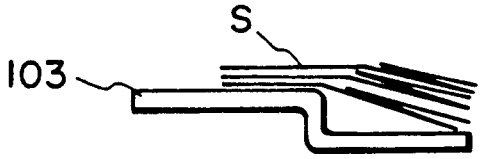
Figure 13A:
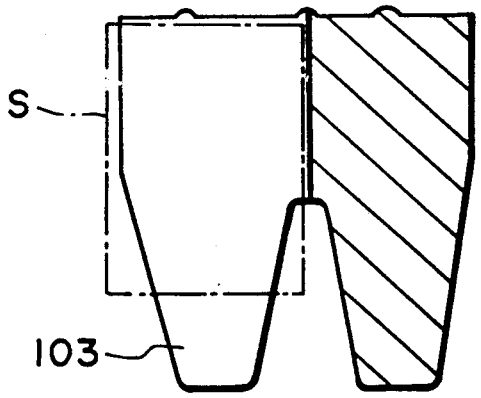
Figure 13B:
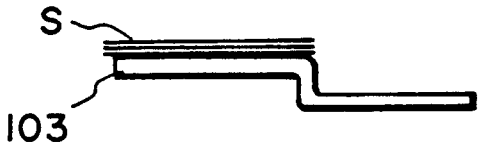

By the provision of a recess at a right half, the folded sheets can be stacked in good order (FIG. 12). If the sheets are not folded, the stacking tray 103 is shifted to right, as shown in FIG. 13, and the sheets are stacked avoiding the recess, so that the alignment of the sheets are in good order.

In the foregoing embodiments, the accommodating portion side is made horizontally movable, but it is a possible alternative that the discharging portion side is made movable. For example, the pair of discharging rollers to the accommodating portion is movable in a direction perpendicular to the sheet conveying direction, wherein the non-processed sheets S are discharged straight, whereas the post-processed sheets S are discharged inclinedly by the shifting of the discharging rollers to discharge them to the accommodating portion having the configuration proper to the processed sheets.

As described in the foregoing in conjunction with FIGS. 9–13, according to these embodiments, the relative position between the accommodating portion disposed downstream of the sheet post-processing means and the discharging portion to the accommodating portion is changeable in a horizontal plane in a direction perpendicular to the sheet conveyance direction, wherein the relative position is changeable depending on whether the post-processing is effected or not, by which the post-processed sheets can be received by the configuration proper to such sheets, without adverse influence to the sheet stacking in the non-post-processing mode. Therefore, the sheets can be properly stacked and aligned in any mode without increasing the size of the entire apparatus. In comparison, in a conventional apparatus wherein a cut-away portion is formed at a position corresponding to the stapled portion of the sheets to accommodate the bulge of the sheet, the sheet stacking operation is good when the sheet accommodating portion is exclusively for the stapled sheets, however but if the accommodating portion of the conventional apparatus is also used for receiving the non-processed (non-stapled) sheets, ends of the sheets fall into the cut-away portion, so that the stacking and alignment of the non-processed sheets are not in good order. If separate accommodating portions are provided for the non-processed sheets and the processed sheets in an attempt to avoid the above problem, the size of the apparatus becomes large with the disadvantage of the complicated conveying and control systems.

Level difference between trays

Figure 14:
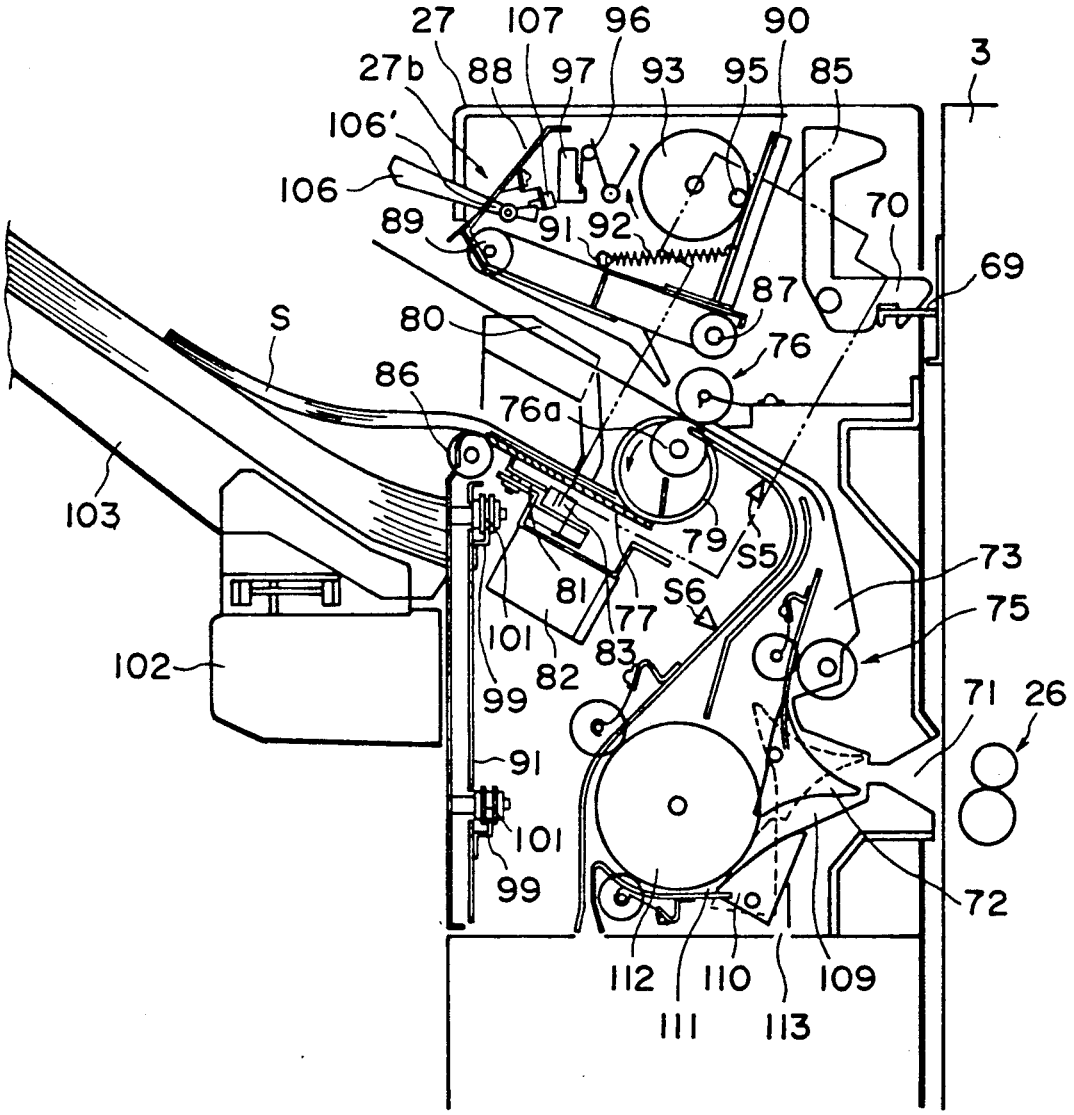
FIG. 14 is a front sectional view of a sheet post-processing apparatus wherein trays are stepped, according to another embodiment of the present invention.

As shown in FIG. 14, in this embodiment, there is a level difference between the processing tray 77 and the stacking tray 103, more particularly the stacking tray 103 is slightly lowered, 1 mm–25 mm, for example, when a first sheet S of each of the jobs is discharged and retained bridging between the processing tray 77 and the stacking tray 103, by which the rigidity of the sheet S in the lateral direction is increased.

This will be described in more detail.

The stacking tray 103 is lowered in the following manner. First, the stacking tray 103 is at a lower standby position. When the copy button is depressed after the stapling mode is selected, the stacking tray 103 starts to elevate. At this time, the rollers 86 and 89 are press-contacted to each other. The elevation of the stacking tray 103 is detected by the sensor lever 106, and when it reaches substantially the same level as the processing tray 77, it stops. Simultaneously with or with a slight delay from the stoppage of the processing tray 103 elevation, the rollers 86 and 89 move apart.

Subsequently, the first sheet having been subjected to the copying operation is discharged through the pair of rollers 76, and is stacked on the stacking tray 103 and the processing tray 77, bridging therebetween. Therefore, the first sheet is stacked on substantially the horizontal trays, so that it is smoothly stacked.

After completion of the first sheet discharge, counting operation of a predetermined number of pulses is started, and the stacking tray 103 is lowered by the amount corresponding to the predetermined number of pulses. By this, a level difference is provided between the stacking tray 103 and the processing tray 77, by which the first sheet already stacked is curved, as shown in FIG. 14. As a result, the rigidity of the sheet is is increased.

After the stacking tray 103 is lowered, the lateral shifting plate 80 is displaced in the lateral direction to push a lateral edge of the sheet to align it in the lateral direction. Then, a predetermined number of sheets are discharged through the rollers 76, and are stacked on the preceding sheets while they are curved. Since the level difference between the trays is covered by the first sheet, the second and subsequent sheets are smoothly received. Each time the sheets are stacked, the lateral shifting plate 80 moves to align the sheet.

When the predetermined number of sheets are stacked, the rollers 86 and 89 are urged relative to each other, and the stapler is actuated t staple the sheets. By rotation of the rollers 86 and 8 he stapled sheets are discharged and received by the stacking tray 103.

Simultaneously with the completion of the stapled sheet discharge or with a slight delay therefrom, the stacking tray 103 lowers until the top surface of the stacked stapled sheet is substantially at the same level as the top surface of the processing tray 73. The distance of the lowering is determined by the number of sheets stacked on the stacking tray 103 which has been counted. Practically, the motor rotates by the number of pulses produced in accordance with the memory of the count, so that the stacking tray 103 lowers by the corresponding amount.

Simultaneously with the completion of the lowering of the stacking tray 103 or with slight time delay therefrom, the rollers 86 and 89 are moved away from each other. Subsequently, the first sheet of the next job is discharged through the nip between the rollers 76, and is stacked on the last sheet of the previous job and the processing tray 77, bridging therebetween.

Then, the stacking tray 103 is lowered through a predetermined amount, so that a level difference is provided between the top surface of the stapled sheet and the processing tray 77. Then, the same operation as described is repeated.

Operation of the entire copying apparatus

Figure 15:
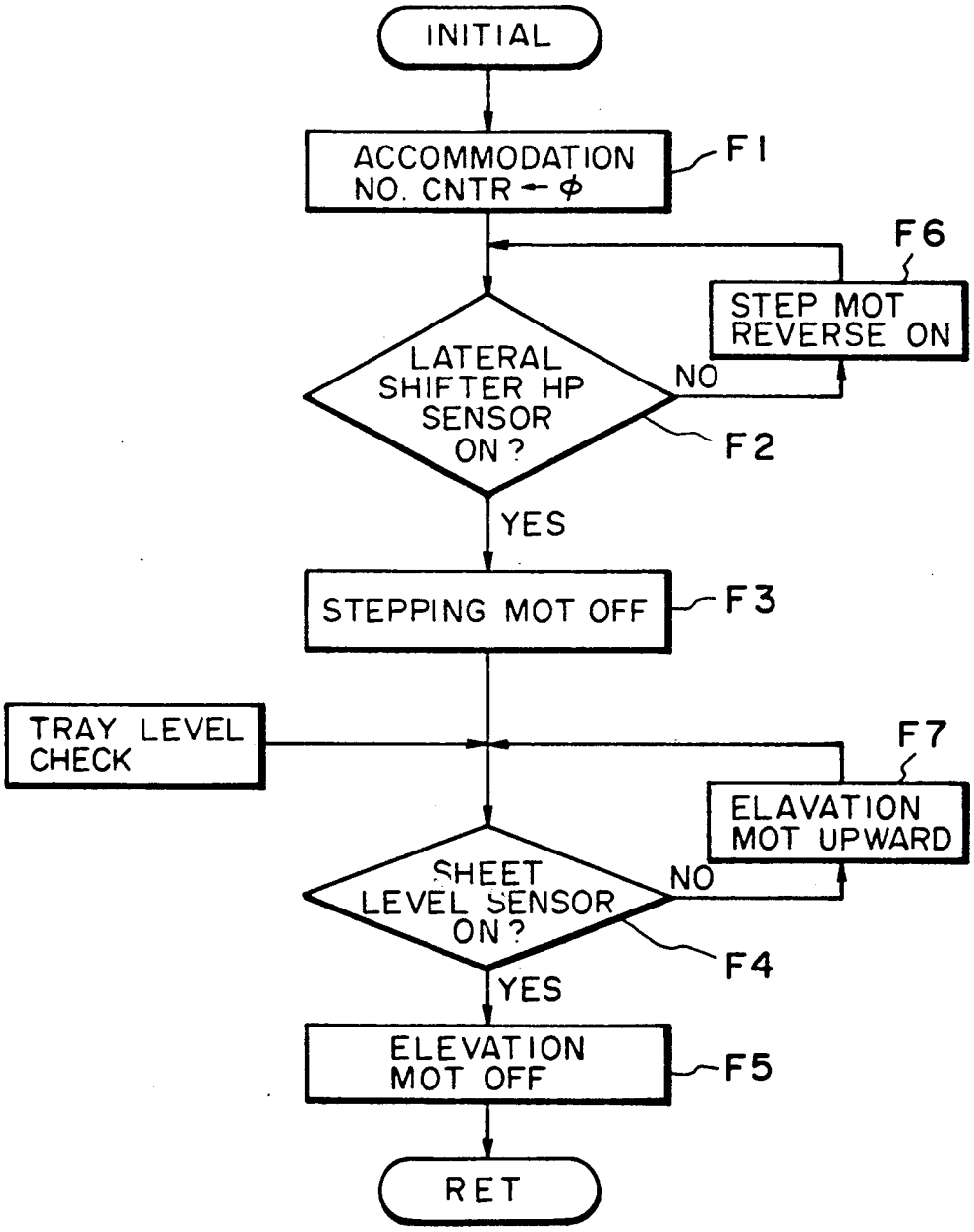
FIGS. 15 and 16, 16A–B are flow charts illustrating an operation of the sheet post-processing apparatus.
Figure 16A:
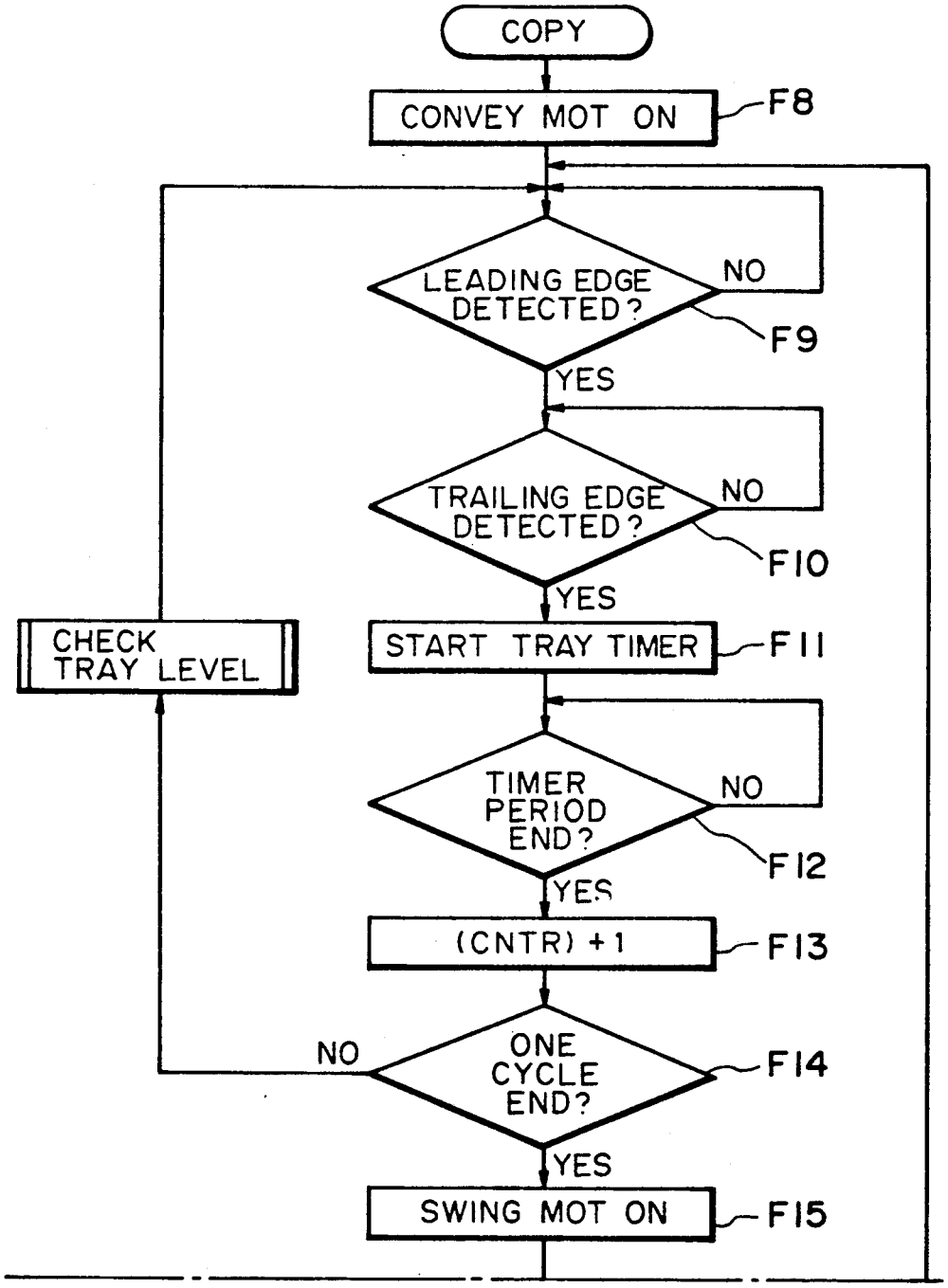
Figures 16, 16B:
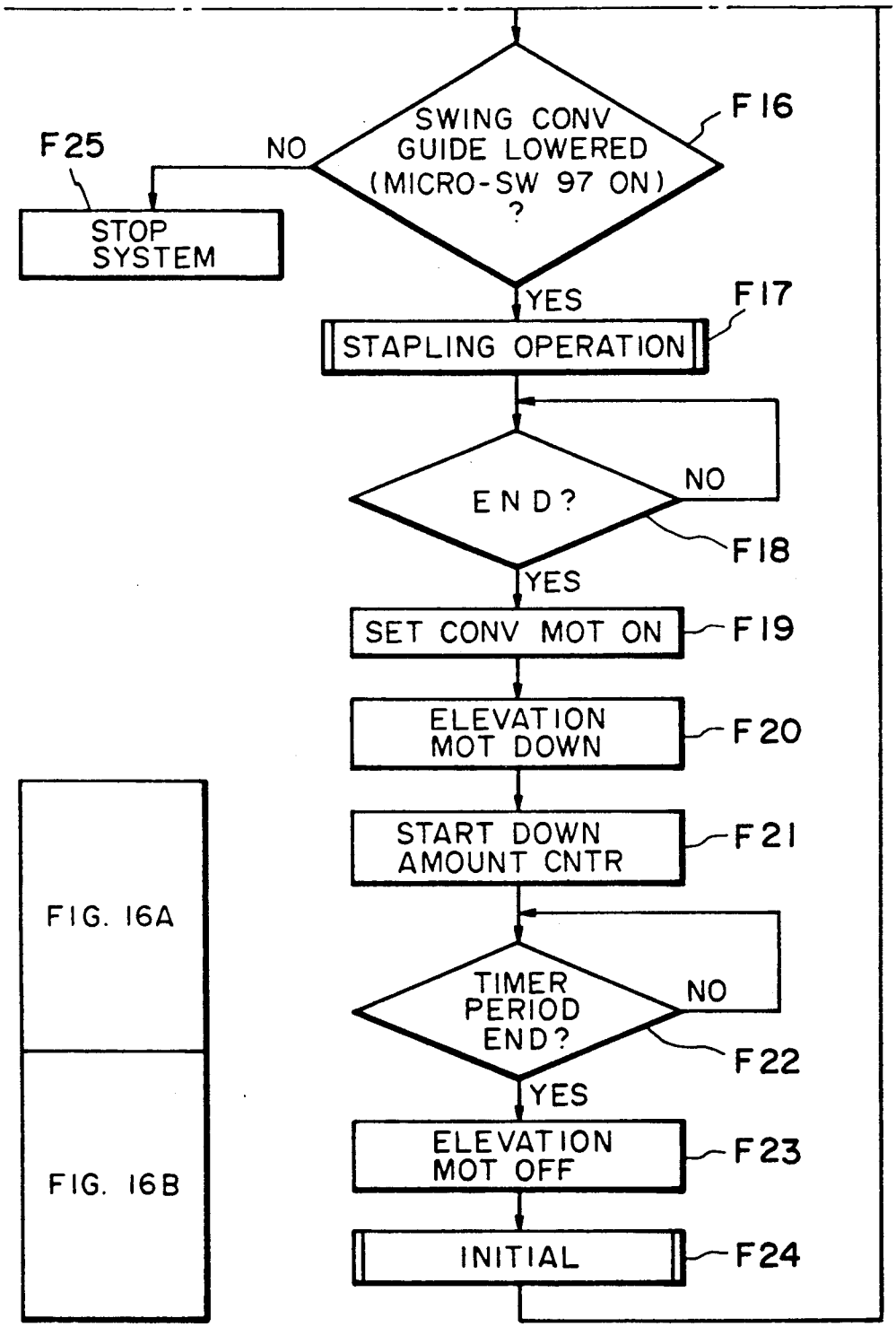

Referring to FIGS. 15 and 16, the operation will be described in conjunction with the flow charts shown therein.

When the power switch is closed, or when the copy button is depressed, the CPU 62 resets to zero the accommodation number counter (F1), and reversely rotates the stepping motor 82 to return the lateral shifting plate 80 to its home position. Then, the CPU 62 discriminates on the basis of a signal from the lateral shifting plate home position sensor S7 as to whether the lateral shifting plate 80 is at the home position or not (F2). If so, the stepping motor 82 is stopped (F3). Further, the CPU 62 actuates the tray elevating motor M4, and discriminates whether or not the sheet level sensor 105 is actuated by the lever 105 being swung by the contact of the stacking tray 103 to the sensor lever 106 (F4). Furthermore, the CPU 62 stops the tray elevating motor M4 to complete the movement of the stacking tray 103 (F5).

By the above operations, the tray 103 is at the same level as the processing tray 77, and therefore, it is in the position for receiving the sheet S.

If the result of discrimination at the step F2 is that the home position sensor S7 is not actuated, the stepping motor 82 is rotated reversely until the sensor S7 is actuated (F6).

If the sheet level sensor 105 is discriminated as not being actuated, the tray elevating motor M4 is rotated in the raising direction until the sensor 105 is actuated.

When the original M (FIG. 1) is stacked on the original tray 32, and then, an unshown start key is actuated, a motor (not shown) is driven so that the feeding roller 33 is driven, and simultaneously, the separating belt 35 is rotated in the counterclockwise direction, and the conveying belt 36 is rotated in the clockwise direction. By this, the original M on the original tray 32 is fed out by the feeding roller 33, and is separated and conveyed one by one by means of the separation belt 35 and the conveying belt 36.

The original M is conveyed to between the platen 5 and the conveying belt 42, and is stopped at an original reference position on the platen 5 by the conveying belt 42. The original M is read by the lamp 6, mirrors 7, 8, 9 and 10 and a lens 11, so that an image is formed in the copying portion 2. On the other hand, a sheet S is fed by a pick-up roller 16, 17 or 19 out of a cassette 12, 13 or a deck 15, whichever is selected by an unshown selection switch. The sheet S is further fed to the copying portion 2 by the registration rollers 21 in synchronism with the image formed in the copying portion 2. The sheet S receives the image from the copying portion 2, and is conveyed to the fixing device 23 by a conveying belt 22.

The fixing device 23 fixes the image on the sheet S. In the case of a simplex copying mode, it is guided by the flapper 25 to the discharging rollers 26, by which it is discharged to the sheet post-processing apparatus 27. When an overlaying or duplex copy mode is selected, the sheet S is branched by the flapper 25 to the sheet refeeding passage 29. In the similar operations, the sheet S is subjected to the copying operation at its front or backside and is conveyed to the sheet processing apparatus 27.

The CPU 62 of the processing apparatus 27 receives the start signal from the copying machine 3, upon which it energizes the conveying motor M5 to drive the rollers (F8, in FIG. 16). If the stapling mode is selected on the operating panel (not shown) of the copying machine 3, the CPU 62 actuates the swinging motor M2 to rotate the disk 93 through a predetermined rotational amount to swing the guide lever 90 in the clockwise direction through the pin 95 integrally rotatable with the disk 93.

The swinging movement of the lever 9 swings the swing guide 88 about the shaft 89 in the clockwise direction, so that the swinging roller 89 and the discharging roller 86 become apart.

The sheet S discharged from the copying machine 3 is received by the inlet 71 and is guided to the first conveyance passage 73 or the second conveyance passage 109 selectively by the deflector 72. For example, if the non-folding mode is selected, the sheet S is guided to the first conveyance passage 73, and is conveyed to the sheet discharging rollers 76 by the conveying rollers 75 (FIG. 8A). At this time, the CPU 62 discriminates on the basis of the signal from the sheet detection sensor S5 whether the sensor S5 detects the leading edge of the sheet S (F9). If so, the discrimination is made as to whether or not the sensor S5 detects the trailing edge of the sheet S (F10). If so, the CPU 62 starts a tray accommodation timer having a predetermined timer period (F11).

The sheet S is discharged by the sheet discharging rollers 76, so that it is stacked both on the processing tray 77 and the stacking tray 103, bridging therebetween (FIG. 8B). Then, the stacking tray 103 lowers slightly, and the sheet is pushed by the lateral shifting plate 80 to be abutted to the positioning plate, by which it is aligned in the lateral direction. Simultaneously, the sheet is abutted to the base side end of the processing tray 77 to be aligned in the sheet conveyance direction by a discharging roller 76 rotating in the clockwise direction only for the first sheet S and the belt 79 rotating in the counterclockwise direction. When the tray accommodation timer counts up (F12), the CPU 62 increments the accommodation number counter (F13), and it discriminates on the basis of the signal from the sensor S4 whether or not the original M is circulated by one cycle, that is, whether or not the one cycle of the copy processing is completed (F14). When it is discriminated that the one cycle copy is not completed, the CPU 62 checks the level of the stacking tray 103 in the manner as in the steps F4 and F5, and performs the operations the step F9 and the subsequent steps. This is to detect the excessive amount stacking.

When the completion of the one cycle copy processing operation is detected, the CPU 62 actuates the swinging motor M2 to rotate the disk 93 in the clockwise direction (F15). By the rotation of the disk 93, the urging force to the guide lever 90 by the pin 95 disappears, with the result that the lever 90 is urged by the spring 92 in the counterclockwise direction. The lever 90 is brought into contact with the leaf spring 96 to swing it in the counterclockwise direction, by which the microswitch 97 is actuated, whereupon the CPU 62 stops the swinging motor M2 (F16). At this time, the swinging movement of the lever 90 swings the swing guide 88 integrally with the lever 90 in the counterclockwise direction, by which the discharging roller 86 and the swinging roller 89 are brought into contact with each other.

Figure 17:
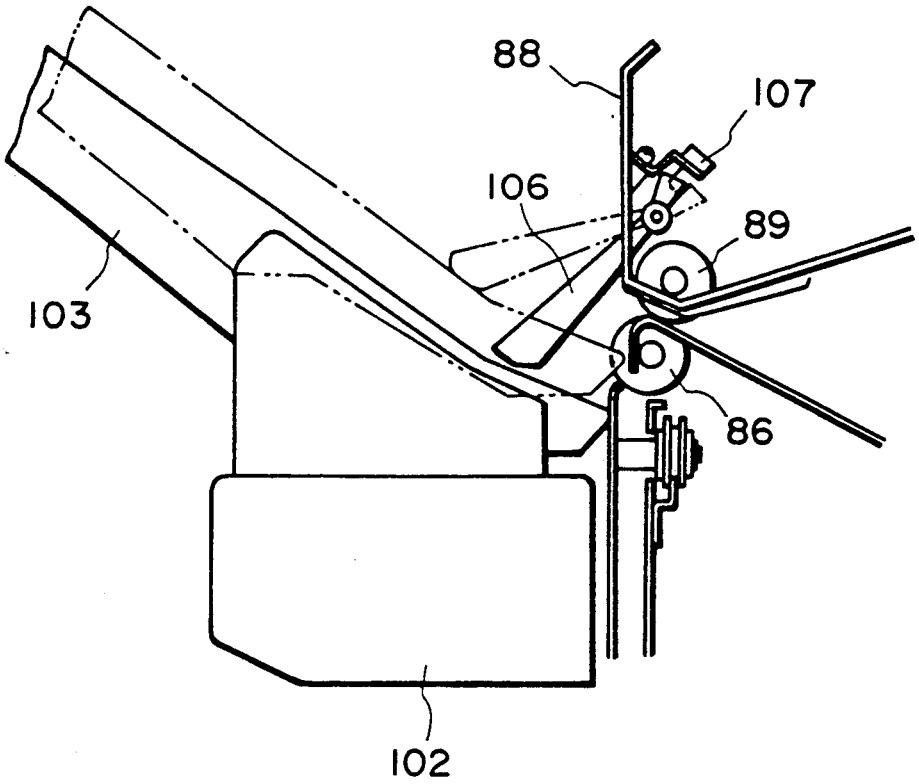
FIG. 17 is a partial front view illustrating movement of a sensor lever.

The CPU 62 by an unshown sensor confirms that a sheet S is present on the processing tray 77, and thereafter, it actuates the stapler 85 to staple the sheets S (F17). After the completion of stapling operation (F18), the CPU 62 actuates a stapled sheet conveying motor M1 (F19) to cause the sheet discharging rollers 86 and the swinging rollers 89 to discharge the stapled set of sheets S onto the stacking tray 103 (FIG. 8C). At this time, the stapled set urges upwardly the sensor lever 106, and therefore, the beam for the photosensor 107 is passed (FIG. 17).

Figure 8D:
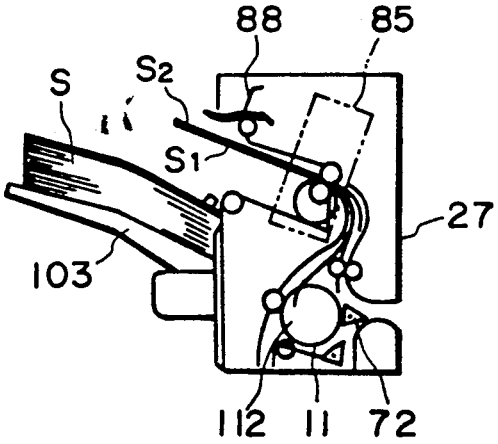

The first sheet S1 of the next job is guided to the third conveyance passage 111 by the deflector 72 and is stagnated in the passage 111. After the stapled set of sheets S in the previous job is discharged, and is discharged onto the processing tray 77 together with the second sheet S2 overlaid (FIG. 8D). The CPU 62 actuates the tray elevating motor M4 to lower the stack tray 103 (F20), and starts the counting operation for counting the lowering amount corresponding to the number of accommodated sheets (F21). For example, the timer period is set to be slightly larger than the thickness of the sheet, such that, for example when the sheet thickness is 0.1 mm, the count 10 corresponds to 2 mm lowering, and a count 20 corresponds to 2 mm lowering. When the timer counts up (F22), the CPU 62 deactivate the tray elevating motor M4 (F23). At this time, the CPU 62 shifts by an unshown driving means the stacking tray 103 and the hurdle guide 100 in the lateral direction to off-set the stapled set of sheets S on the tray 103 to prevent the next set of stapled sheets is overlaid in alignment, thus preventing the stapled portions from bulging. Then, the CPU 62 executes the initial processing, i.e., the steps F1–F5 (F24), and the operations of F9 and the subsequent steps are performed for the next job.

If, in the above-described step F16, the microswitch 99 is not actuated (although the cam 93 rotates to control the sensor 94, the lever 90 does not rotate counterclockwisely (FIG. 3)), that is, when foreign matter (book, finger or hand, for example) is on the processing tray 77, the CPU 62 stops the system (F25).

When the folding mode is selected, the sheet S received by the inlet 71 is guided to the deflector 110 by the deflector 72, and is guided to the folding portion 27*a* through the fourth conveyance passage 113. In the folding portion 27*a*, it is two-folded or Z-folded. The folded sheet is fed to the third passage 111 by a large roller 112, and is subjected to the operation of the step F8 and the subsequent steps.

When the non-stapling mode is selected, the swinging roller 89 is disposed at a position press-contacted to the discharging roller 86 (FIG. 3), the sheet S received by the inlet 71 is guided to the first conveyance passage 73 by the deflector 72, and is directly discharged to the stacking tray 103 by the discharging rollers 76, the sheet discharging roller 86 and a swinging roller 89.

Figure 18:
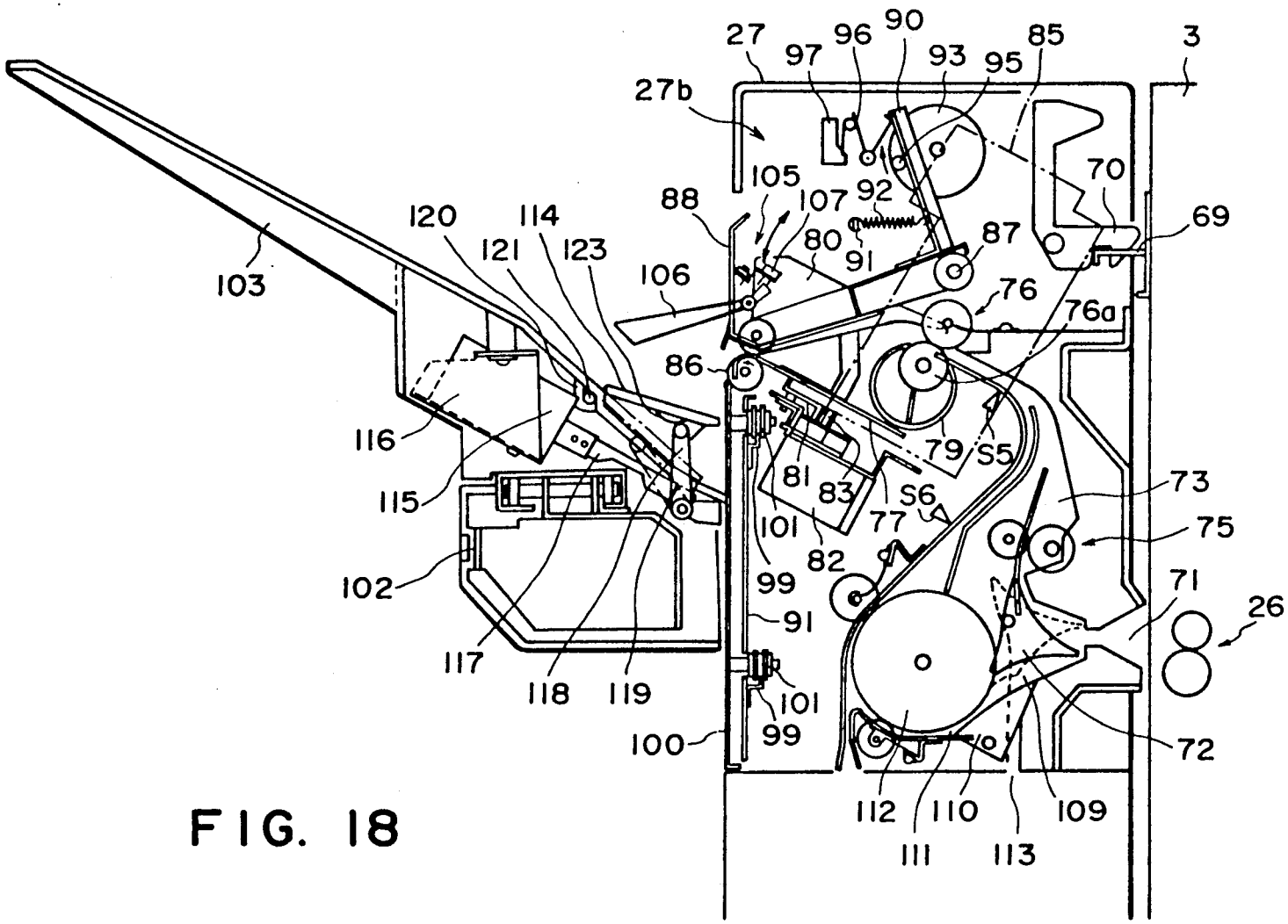
FIG. 18 is a front sectional view of a sheet post-processing apparatus showing in detail an auxiliary tray.
Figure 19:
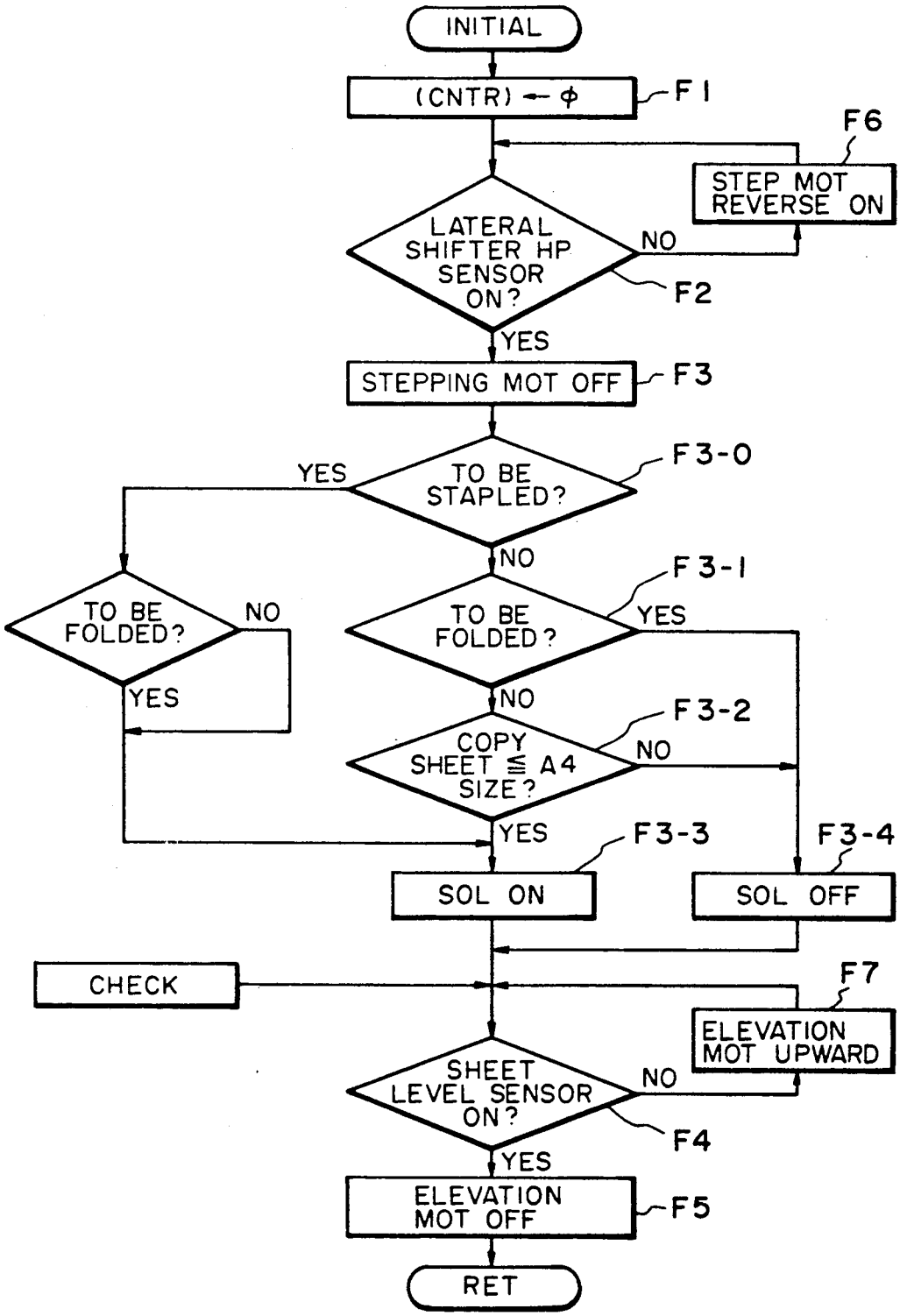
FIG. 19 is a flow chart illustrating movement of the auxiliary tray.

As shown in FIG. 18, a hinge 121 of a vertically movable auxiliary tray 114 is loosely mounted into a hinge hole 120 of the stacking tray 103, and the auxiliary tray 114 is urged downwardly by gravity to itself. A solenoid 115 is mounted on the stacking tray 103 through a mounting plate 116. As shown in FIGS. 19A, 19B and 19C, the discrimination is made as to whether or not the stapling operation is to be performed (F3-0). If not, the discrimination is further made as to whether the folding operation is to be performed (F3-1). If so, the solenoid 115 is deenergized (F3-4), since the leading edge portions bulge without the trailing portions bulging.

When the folding is not performed, solenoid is energized (F3-3) if the size of the sheet S is A4 or smaller (F3-2), since the trailing edges do not bulge. If the size is B4 or A3, the solenoid 115 is deenergized (F3-4) in order to prevent the trailing edges from bulging.

The auxiliary tray 114 is at the solid line position of FIG. 18, and is supported by an arm 118 urged in the clockwise direction by the spring 119. The bottom of the auxiliary tray 114 is formed into a cam 123 so as to prevent the auxiliary tray 114 from falling in the clockwise direction even when a heavy stack of sheets S is loaded on the auxiliary tray 114.

When the stabling operation is to be performed, the priority of discrimination is placed thereon rather than whether the folding operation is performed or not, and the link 117 connected with the plunger of the solenoid 115 is retracted irrespective of whether the folding operation is to be performed or not. This rotates the arm 118 in the counterclockwise direction to place the auxiliary tray 114 at the position indicated by chain lines in FIG. 18, the level is controlled such that the stack tray 103 is on an extension of the processing tray 77.

Figure 20:
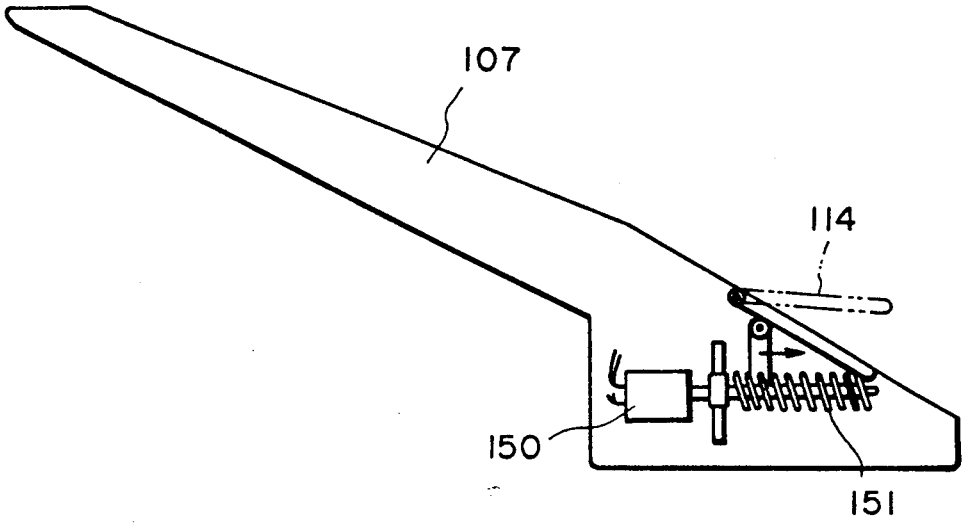
FIG. 20 shows another example of an auxiliary tray.

In this embodiment, the operation of the auxiliary tray 114 is controlled by the solenoid 115, and therefore, the control is a bi-level control. Versatility of control can be provided by using a motor 150 in the driving system and performing multi-level control with the use of a warm 151 or a crank mechanism, as shown in FIG. 20.

Figure 21:
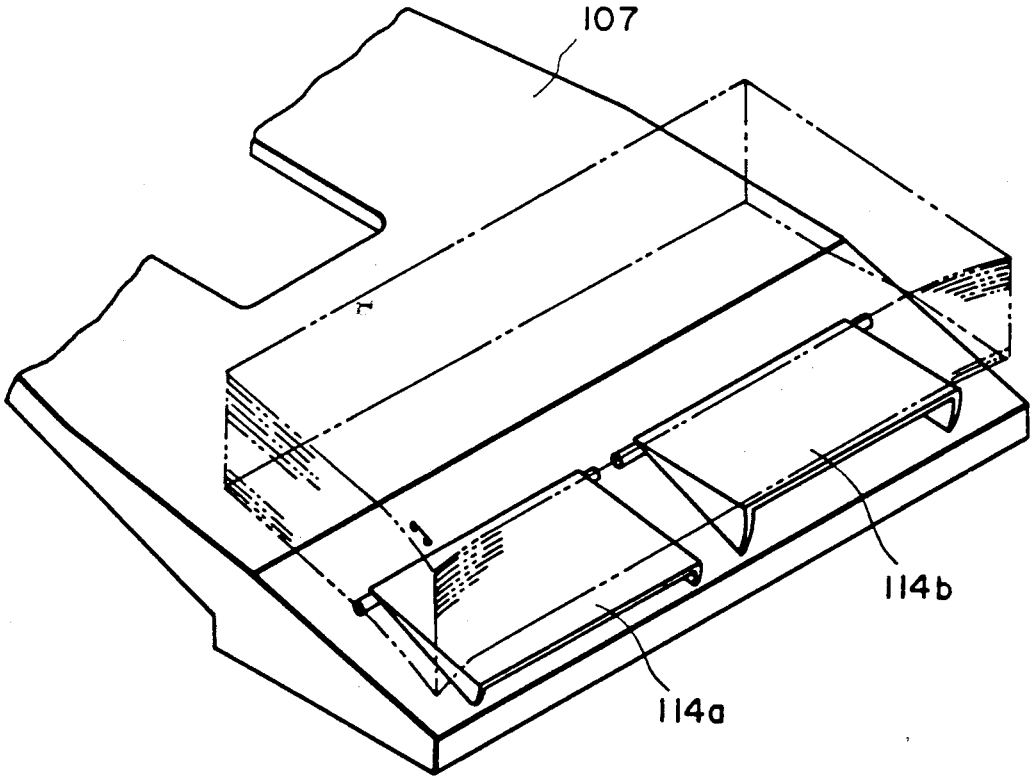
FIG. 21 is a perspective view of a further example of the auxiliary tray.

As shown in FIG. 21, the auxiliary tray 114 may be divided into two parts, more particularly into a rear side auxiliary tray 114*b* and a front side auxiliary tray 114*a*, and the levels thereof are made gradual in accordance with the number of sheets S or the number of sets of stapled sheets stacked, by which the bulge of the stapled portions is accommodated to maintain uniform flatness of the top surface of the sheet S, by which the number of stackable sheets S can be increased.

As described in conjunction with FIGS. 18–21, by providing a simple structure vertically movable auxiliary tray (retractable) for the accommodating tray, and by selectively elevating (using) the auxiliary tray in accordance with the size of the sheet and the operational mode, the stackable capacity and the alignment of the sheets are improved. In addition, the auxiliary tray can be elevated or lowered in accordance with the upper or lower curling of the trailing edges of the sheets. Preferably, it is constituted by movable tray and a fixed tray. The trailing edge side of the movable tray is provided with a step to limit the trailing edge of the sheet in consideration of the discharge of stapled sets of sheet. Therefore, the inclination of the tray there is large. Therefore, when the sheet is not stapled, the sheet is curled, particularly curved down. Or, when the size of the sheet is large (A3 or B4, for example), the trailing edge of the sheet becomes concave by its own weight. These adversely influence the alignment on the accommodating tray to remarkably reduce the sheet stacking capacity. These drawbacks are eliminated in the embodiments.

Special mode

The description will be made as to a special mode wherein the conveying means (swinging guide 88) to the stacking tray 103 is not operated.

A sheet S having a regular one of sizes is fed from a cassette 12, 13 or a deck 15 in FIG. 1. However, a special sheet such as irregular size sheet (post card or the like) or an OHP (overhead projector) sheets is fed from the manual feeding tray 14.

Figure 22A:
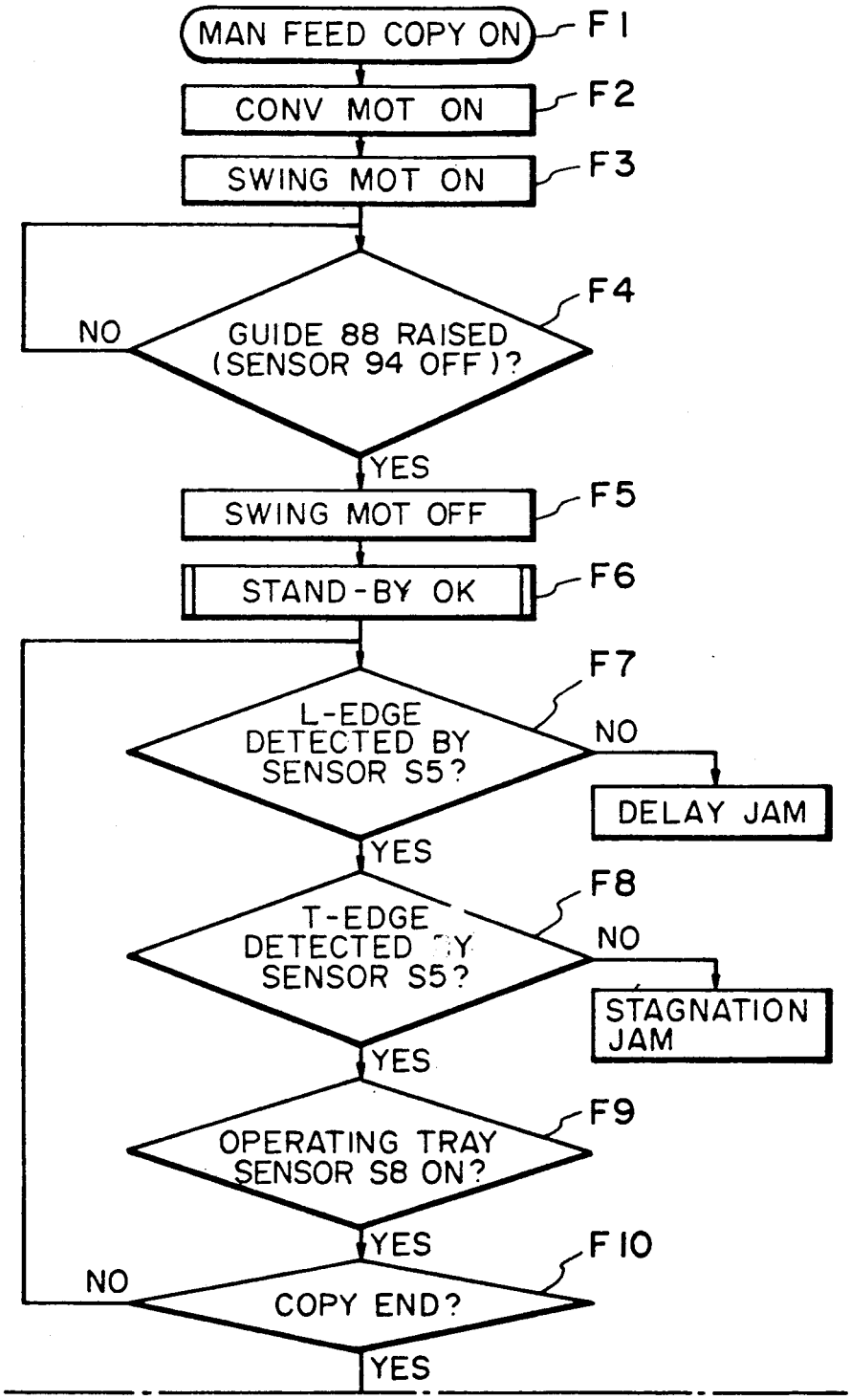
FIGS. 22, 22A–B are flow charts illustrating a special operation mode.
Figure 22B:
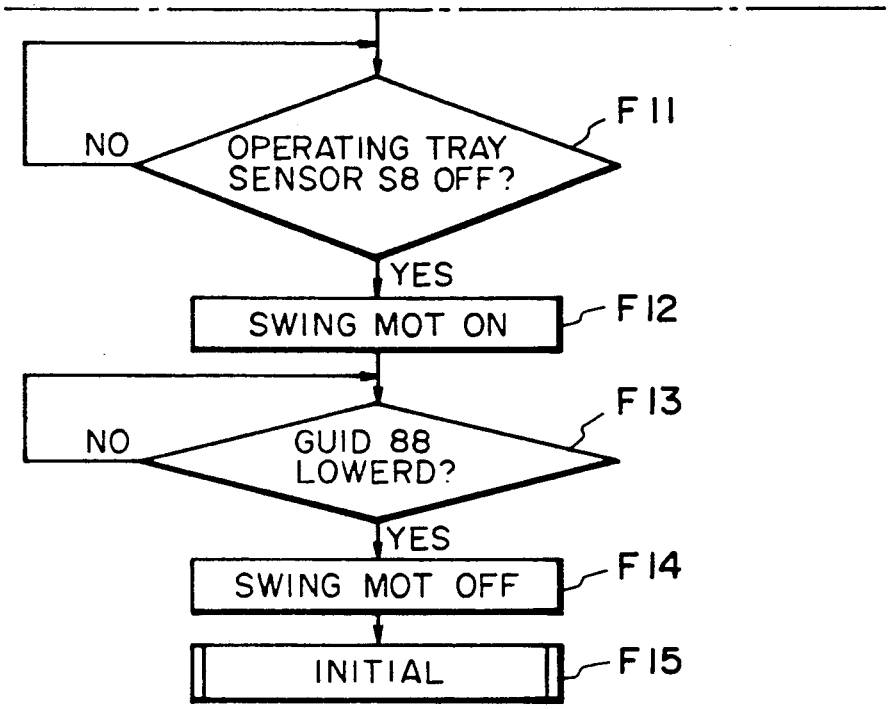
Figure 22:
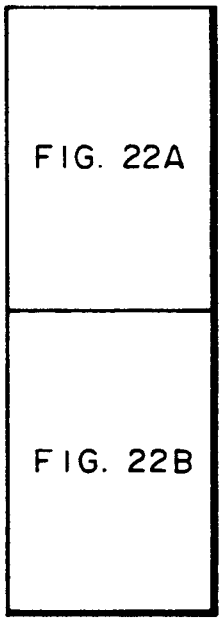

As shown in FIG. 22, when a signal representing the manual feed is received from the main assembly 3 (F1), the sheet post-processing apparatus 27 drives the swinging motor M2 (F2, F3) to rotate the pin 95 planted in the disk 93 (FIG. 3) in the clockwise direction so as to rotate the guide lever 90 planted in the swinging guide 88 about the shaft 87, thus raising the swinging guide 88. The disk 93 is provided with cut-away portions (FIG. 3) at the positions corresponding to the upper and lower movements of the swinging guide 88. By detecting the cut-away portions by the sensor 94, it can be stopped at the upper or lower position (F4, F5). Then, it is prepared for receiving the sheet.

In FIG. 1, the special sheet fed from the manual tray 14 is picked up by the pick-up roller 18 and is conveyed further by the registration rollers 21 in synchronism with the image formed in the copying portion 2. The sheet S receives the image in the copying portion 2, and is further conveyed by the conveying belt 22 to a fixing device 23, where the image is fixed thereon. It is then guided by the flapper 27 and is conveyed to the processing apparatus 27 by the discharging rollers 26.

The sheet S discharged from the copying machine 1 is received by the inlet 71, and is guided to the first conveying passage 73 by the deflector 72. Further, it is conveyed to the discharging rollers 76 by the conveying rollers 75. At this time, the leading and trailing edges of the sheet S is detected by the sensor S5 (F7, F8), and finally the sheet S is received by the processing tray 77 and the stacking tray 103, bridging therebetween.

The second and subsequent sheets S from the manual feeding tray 14 are received, bridging the trays 77 and 103. Even if a predetermined number of sheets are stacked, the swinging guide 88 and the swinging roller 89 are not lowered, and the sheets are not conveyed to the stacking tray 103. The processing tray 77 is provided with a sheet detecting sensor S8. When the sensor S8 is deactuated (F11), it is discriminated that the sheet S is removed from the processing tray 77, and therefore, the swinging guide 88 is lowered by the swinging motor M2, and the initial state is established (F112-F115). In a second example for the special mode, even when only one copy is to be produced, the conveying means (swinging guide 88, swinging roller 89) is prevented from operating. When a signal indicating the number of copies to be produced is one is generated in the main apparatus 3, the swinging guide 88 is raised irrespective of whether the post-processing operation is to be performed or not. The sheet S is discharged so that it bridges between the processing tray 77 and the stacking tray 103. If the post-processing is required it is performed. At this time, the swinging guide 88 lowering operation and the conveying operation are not performed. The above-described mode of operation is not usable when the number of copies to be produced is plural, because the processing tray 77 is required to be made empty. However, it is usable for a single copy production. As a result, the length of the conveying passage is shortened by the conveying path formed between the processing tray 77 by the lowering of the swinging guide 88, so that the likelihood of the paper jam is reduced, and the damage to the sheet S can be reduced. Particularly when the conveying path is the curved one as shown in FIG. 3, the advantages are significant.

A third example of the special mode wherein the conveying means is not operated, is effective when abnormal condition such as excessive loading occurs.

For example, it is assumed that the amount of sheets on the stacking tray 103 reaches the capacity limit during operation in a usual mode. If continued stacking involves the likelihood that the sheets S on the stacking tray 103 is pushed to cause it to fall, the swinging guide 88 is raised to receive the sheet so that it bridges between the processing tray 77 and the stacking tray 103. By doing so, the actual stacking capacity is increased.

As described in conjunction with FIGS. 3 and 22, according to the provision of the special mode, the conveying means is disabled when the conditions of the sheet to be conveyed, that is, size, thickness, number and the place (n(th)) are different or expected to be different from the normal conditions. Thus, the reliability and the operation rate of the apparatus is increased, and in addition, the latitude for the special sheet is increased.

This is because the following disadvantages can be eliminated:

(1) If the sheets coming from the upstream side are all discharged to the sheet accommodating tray by the conveying means (86 and 89) irrespective of whether the post-processing is to be effected or not, the conveying means has to convey the sheet which is not suitable for the conveying means, with the result that the reliability of the apparatus is decreased, and the operation rate thereof is decreased by sheet jam or other failures. For example, in order to meet the sheet having a large thickness and short length such as post card, if the distance between adjacent rollers of the conveying means and the conveyance path configuration is imposed severe conditions. The imposition is adversely influential to the regular sheets most frequently used.

(2) A longer distance of the conveyance results in a higher liability of sheet jam.

Figure 23:
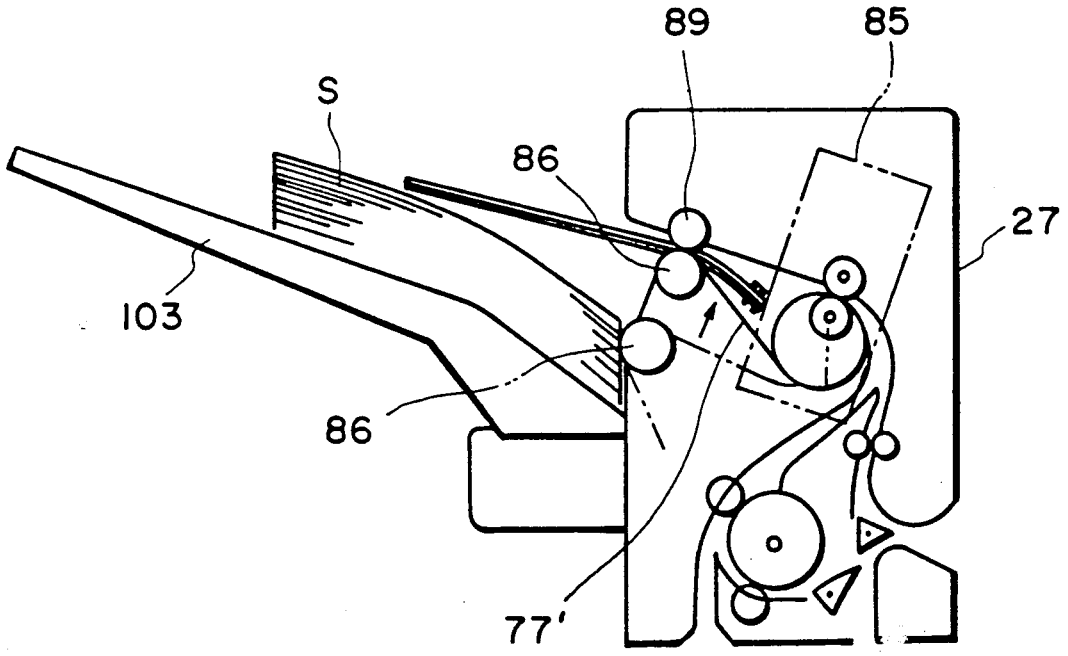
FIG. 23 shows another example of a structure for engagement and disengagement of rollers 86 and 89.

In the foregoing embodiments, the roller 89 is swingable, but this is not limiting, and it is possible that the processing tray 77 is swingable, as shown in FIG. 23.

In addition, as shown in FIG. 23, the processing tray 77' may be maintained at a position swung slightly in the vertical direction, when the sheet is aligned. The same advantageous effects can be provided.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus, comprising:

plural trays arranged along a sheet conveyance direction, wherein a sheet is stacked bridging between the plural trays, and wherein the sheet is post-processed in a part of the plural trays;

means for controlling said trays to provide a level difference between a portion of the sheet on one of said trays and another portion of the sheet on another one of said trays by a lowering of said another tray in relation to said one of the trays; and aligning means for laterally aligning the sheet stacked, bridging between said trays providing the level difference.

2. An apparatus according to claim 1, further comprising means for discharging to another tray the sheet which is post-processed while bridging said plural trays.

3. An apparatus according to claim 2, wherein said discharging means includes rotatable means movable between an inoperative position and a operative position, wherein the inoperative position is taken when the sheet is stacked, bridging between said plural trays, and the operative position is taken when it is discharged to said another tray.

4. An apparatus according to claim 3, wherein said rotating means includes a pair of discharging rollers for relative movement therebetween.

5. An apparatus according to claim 4, further comprising guiding means for guiding the sheet to said discharging rollers when they are contacted to each other to directly discharge the sheet to said another tray.

6. An apparatus according to claim 2, further comprising means for detecting a number of sheets which are post-processed and discharged to said another tray, and for lowering another tray by a distance corresponding to the number.

7. A sheet post-processing apparatus, comprising:

means for receiving a sheet on which an image has been formed;

a processing tray, disposed downstream of said receiving means with respect to a conveyance direction of the sheet, to receive the sheet;

a sheet accommodating tray, disposed downstream of said processing tray with respect to the same direction, to stack the sheet;

means for substantially vertically moving said sheet accommodating tray;

means, associated with said processing tray, to post-process the sheet; and control means for controlling said vertical movement means to lower said sheet accommodating tray to provide a level difference between said processing tray and said sheet accommodating tray when the sheet is stacked on and bridging the processing tray and the sheet accommodating tray for the post-processing.

8. An apparatus according to claim 7, wherein said sheet receiving means includes a rotatable member and is effective to guide a leading edge of the sheet to said sheet accommodating tray, and a trailing edge thereof falls onto said processing tray.

9. An apparatus according to claim 8, further comprising a pair of rotatable members for relative movement toward and away from each other in substantially vertical direction, said rotatable members being disposed adjacent a boundary between said sheet accommodating tray and said processing tray; and guiding means for guiding to said pair of rotatable members the sheet received thereby when they are contacted.

10. An image forming apparatus, comprising:

sheet feeding means for feeding a sheet;

image forming means for forming an image on a sheet fed by said sheet feeding means;

conveying means for conveying the sheet on which the image has been formed;

means for receiving the sheet conveyed by said conveying means;

a processing tray, disposed downstream of said receiving means with respect to a conveyance direction of the sheet, to receive the sheet;

a sheet accommodating tray, disposed downstream of said processing tray with respect to the same direction, to stack the sheet;

means for substantially vertically moving said sheet accommodating tray;

means, associated with said processing tray, to post-process the sheet; and control means for controlling said vertical movement means to lower said sheet accommodating tray to provide a level difference between said processing tray and said sheet accommodating tray when the sheet is stacked on and bridging the processing tray and the sheet accommodating tray for the post-processing.

11. An apparatus according to claim 10, further comprising a circulation type original feeding apparatus including a tray for stacking originals to be copied, and a path for feeding one by one the originals from the tray to a reading position, and for returning it to the tray from the reading position.

12. An apparatus according to claim 11, said processing tray is provided with stapling means to staple copy sheets discharged by one circulation of a set of originals.

13. An apparatus according to claim 12, further comprising means for discharging the stapled set of sheets to said sheet accommodating tray and means for shifting said sheet accommodating tray in a lateral direction of the sheet to group the sets of sheets stapled.

14. An image forming apparatus provided with a sheet post-processing apparatus, comprising:

plural trays arranged along a sheet conveyance direction, wherein a sheet is stacked, bridging between the plural trays, wherein a post-processing is effected on the sheet in a part of the plural trays;

means for controlling said trays to provide a level difference between a portion of the sheet on one of said trays and another portion of the sheet on another one of said trays by a lowering of said another tray in relation to said one of the trays; and aligning means for laterally aligning the sheet stacked, bridging between said trays providing the level difference.

15. An apparatus according to claim 14, further comprising means for discharging to said another tray the sheet which is post-processed while bridging said plural trays.

* * * * *

UNITED STATES PATENT AND TRADEMARK OFFICE

CERTIFICATE OF CORRECTION

PATENT NO. : 5,137,265

DATED : August 11, 1992

INVENTOR(S) : SATO et al.

It is certified that error appears in the above-identified patent and that said Letters Patent is hereby corrected as shown below:

IN THE DRAWINGS

FIGURE 15

"ELAVATION" should read --ELEVATION--.

FIGURE 22

"LOWERD" should read --LOWERED--.

COLUMN 1

Line 22, "drawbacks" should read --drawback--.

COLUMN 2

Line 21, "sheet" should read --a sheet--.

COLUMN 4

Line 37, "plate 90" should read --plate 99--.
Line 59, "conveying" should read --folding--.

UNITED STATES PATENT AND TRADEMARK OFFICE

CERTIFICATE OF CORRECTION

PATENT NO. : 5,137,265

DATED : August 11, 1992

INVENTOR(S) : SATO et al.

It is certified that error appears in the above-identified patent and that said Letters Patent is hereby corrected as shown below:

COLUMN 5

Line 18, "a" should be deleted.

COLUMN 7

Line 50, "sheets, how-" should read --sheets. How- --.
Line 51, "but" should read --,--.

COLUMN 9

Line 17, "lever 105" should read --lever 106--.

COLUMN 10

Line 7, "lever 9" should read --lever 90--.

COLUMN 11

Line 33, "99" should read --97--.

COLUMN 12

Line 64, "one of sizes" should read --size--.

UNITED STATES PATENT AND TRADEMARK OFFICE

CERTIFICATE OF CORRECTION

PATENT NO. : 5,137,265

DATED : August 11, 1992

INVENTOR(S) : SATO et al.

It is certified that error appears in the above-identified patent and that said Letters Patent is hereby corrected as shown below:

COLUMN 13

Line 21, "flapper 27" should read --flapper 25--.

COLUMN 14

Line 31, "is imposed" should read --imposes--.

Signed and Sealed this

Twenty-sixth Day of October, 1993

Attest:

Bruce Lehman

BRUCE LEHMAN

Attesting Officer

Commissioner of Patents and Trademarks